US005795169A

United States Patent [19]

Reed

[11] Patent Number: 5,795,169

[45] Date of Patent: Aug. 18, 1998

[54] ELEVATED ELECTRICAL CONNECTOR ASSEMBLY

[76] Inventor: Lehman Thoren Reed, 3219 Candlewood Dr., Bakersfield, Calif. 93306

[21] Appl. No.: 758,781

[22] Filed: Dec. 3, 1996

[51] Int. Cl.[6] ..... H01R 4/60

[52] U.S. Cl. ..... 439/191; 166/65.1

[58] Field of Search ..... 439/191, 190, 439/194, 195; 166/65.1

[56] References Cited

U.S. PATENT DOCUMENTS

| | | | |
|---|---|---|---|
| 2,014,288 | 9/1935 | Noschang | 439/191 |
| 2,748,358 | 5/1956 | Johnston | 439/195 |
| 2,750,569 | 6/1956 | Moon | 439/195 |
| 4,708,201 | 11/1987 | Reed | 166/65.1 |
| 4,842,059 | 6/1989 | Tomek | 166/65.1 |
| 5,389,003 | 2/1995 | Van Steenwyk et al. | 439/191 |

*Primary Examiner*—Khiem Nguyen
*Assistant Examiner*—Eugene G. Byrd
*Attorney, Agent, or Firm*—F. Eugene Logan

[57] ABSTRACT

An elevated electrical connector assembly for use with electric submersible pumps. The assembly is particularly useful for wells at elevated temperatures. The assembly has a removable tubular assembly housing, a removable lower electrical connector, a removable annular retainer member, a removable crossover sealing adapter, a removable upper electrical connector, and a removable locking member. The housing is connected to a wellhead member and extends out the top of the wellhead. The electrical connectors are in a part of the housing that is outside of the wellhead. By elevating the electrical connectors and their mutual junctions away from the hot wellhead, ambient air can provide sufficient cooling of the assembly to prevent connector failure due to high temperatures. A swivel part in the tubular assembly housing permits the connectors to be angled away from hot components in the flow path from the wellhead. A spark containment feature prevents inadvertent ignition of combustibles in the surrounding environment cause by spark generation when making or breaking electrical contact.

27 Claims, 19 Drawing Sheets

ELEVATED ELECTRICAL CONNECTOR ASSEMBLY

BACKGROUND OF THE INVENTION

In the past electrical connectors for cables have been located in the wellhead. For example, in U.S. Pat. No. 4,708,201 the lower electrical connector is fastened to the bottom of the tubing hanger, an intermediate electrical connector is connected to the lower electrical connector in the tubing hanger, and the upper electrical connector is connected to the intermediate electrical connector in the bonnet. In such at-the-wellhead configurations the electrical connectors are maintained at wellhead temperature. When the wellhead is at an elevated temperature the electrical connectors can fail. In this invention, by displacing or elevating the electrical connectors and their mutual junctions away from the hot wellhead, ambient air will provide sufficient cooling of the elevated electrical connector assembly to prevent connector failure due to high temperatures.

SUMMARY OF THE INVENTION

Accordingly, there is provided by the principles of this invention an elevated electrical connector assembly for use with electric submersible pumps in wells operating at elevated temperatures. However, this invention can also be used advantageously in wells that are not at an elevated temperature since this invention facilitates some servicing operations of the well.

The elevated electrical connector assembly comprises a removable tubular assembly housing, a removable lower electrical connector, a removable retainer member, a removable crossover sealing adapter, a removable upper electrical connector, and a removable locking member.

The tubular assembly housing includes a first or lower connecting end, a second or upper connecting end and a passageway therebetween, threaded first means for attaching the first or lower connecting end to a threaded coupling port in a first wellhead member, a coupling first part near the second or upper connecting end, and a pass-through part located near the first or lower connecting end for traversing a bore in a second wellhead member. For some wells the first wellhead member is a tubing hanger and the second wellhead member is a bonnet.

The lower electrical connector includes a plurality of shielded electrical conductors, a first or lower cable-connecting end for attachment to a short electrical cable, a second or upper end for electrical connection to the upper electrical connector, below the second or upper end a cylindrical upper first section, and below that a supporting second section. The short electrical cable is for splicing to a long electrical cable connected to an electric submersible pump (not shown in the figures).

The annular retainer member includes supporting second means for maintaining the cylindrical upper first section of the lower electrical connector outside the tubular assembly housing a predetermined distance, D, from second or upper connecting end thereof and for preventing the lower electrical connector from falling through the housing.

The crossover sealing adapter includes a first or adapter lower end, a second or adapter upper end, and an adapter passageway therebetween, and near the adapter's first or lower end, coupling third means for connecting to the coupling first part of the tubular assembly housing. The adapter passageway has a bored first portion which is slidable over the cylindrical upper first section of the lower electrical connector The crossover sealing adapter has sealing fourth means for preventing leakage between its bored first portion and the cylindrical upper first section of the lower electrical connector. Between the adapter's second or upper end and the bored first portion is a bored second portion for accepting the upper electrical connector in the adapter passageway. On the outside of the crossover sealing adapter and near its second or upper end is a coupling third portion for accepting the annular locking member.

The upper electrical connector includes a first or lower end, a plurality of shielded electrical conductors, a second or upper cable-connecting end for electrical connection to a short electrical cable, a first or cylindrical lower sector which is slidable into the bored second portion of crossover sealing adapter, and contact means for making electrical contact between the conductors in the upper electrical connector and the conductors in the lower electrical connector. The short electrical cable is for splicing to a longer electric cable connected to a power source (not shown in the figures).

The locking member includes coupling fifth means for maintaining the first or lower end of the upper electrical connector in abutting relationship with the second or upper end of the lower electrical connector. The coupling fifth means is also for coupling to the coupling third portion of the crossover sealing adapter thereby securing the assembly.

In one embodiment, the pass-through part of the tubular assembly housing has means for preventing leakage between its pass-through part and the bore in the second wellhead member In another embodiment, the elevated electrical connector assembly further comprises an annular member surrounding a portion of the pass-through part, means for attaching the annular member to the second wellhead member, and a pliable seal sandwiched between the annular member, the second wellhead member, and the pass-through part.

In one embodiment, the threaded first means of the housing is an externally threaded section. In another embodiment, the coupling first part of the housing is an externally threaded section, and the coupling third means of the crossover sealing adapter is an internally threaded section which screws onto the externally threaded section at the upper end of the housing. In yet another embodiment, the second or upper connecting end of the tubular assembly housing has flat surface, and the annular retainer member has a lower flat surface which abuts the housing flat surface.

In one embodiment, the cylindrical upper first section of the lower electrical connector is an external cylindrical surface, and the bored first portion of the crossover sealing adapter has an internal cylindrical surface which is slidable over the external cylindrical surface. In another embodiment, the supporting second section of the lower electrical connector is an externally threaded section, and the supporting second means of the annular retainer member is an internally threaded section which screws onto the externally threaded section thereby maintaining the cylindrical upper first section outside the tubular assembly housing the predetermined distance, D, from its second or upper connecting end. In still another embodiment, the lower electrical connector has an external shoulder between its cylindrical upper first section and its supporting second section, and the annular retainer member has an internal shoulder which abuts the external shoulder.

In one embodiment, the annular retainer member has an upper flat surface, and the crossover sealing adapter has an internal shoulder between its bored first portion and its coupling third means which abuts the upper flat surface of the annular retainer member.

In one embodiment, the sealing fourth means of the crossover sealing adapter includes an inner circumferential recess in the bored first portion which supports an pliable seal which, when assembled, abuts the cylindrical upper first section of the lower electrical connector. In still another embodiment, the coupling third portion of the crossover sealing adapter is an externally threaded section, and the coupling fifth means of the locking member is an internally threaded section which screws onto the externally threaded section of the crossover sealing adapter.

In one embodiment, the first or cylindrical lower sector of the upper electrical connector has an external cylindrical surface, and the bored second portion of the crossover sealing adapter has an internal cylindrical surface which is slidable over the external cylindrical surface. In another embodiment, the upper electrical connector has a lower external shoulder between the first or cylindrical lower sector and the second or upper end thereof, and the tubular assembly housing has a flat surface on its second or upper connecting end which abuts the lower external shoulder. In still another embodiment, the upper electrical connector has an upper external shoulder between the first or cylindrical lower sector and the second or upper end thereof, and the locking member has an internal shoulder which abuts the upper external shoulder.

In one embodiment, the upper electrical connector has a pliable seal adjacent the first or cylindrical lower sector thereof, and the seal abuts the bored second portion of the crossover sealing adapter. In another embodiment, the upper electrical connector includes an inner circumferential recess in the first or cylindrical lower sector supporting a pliable seal that abuts the bored second portion of the crossover sealing adapter.

DESCRIPTION OF THE PREFERRED EMBODIMENTS

Figure 1A:
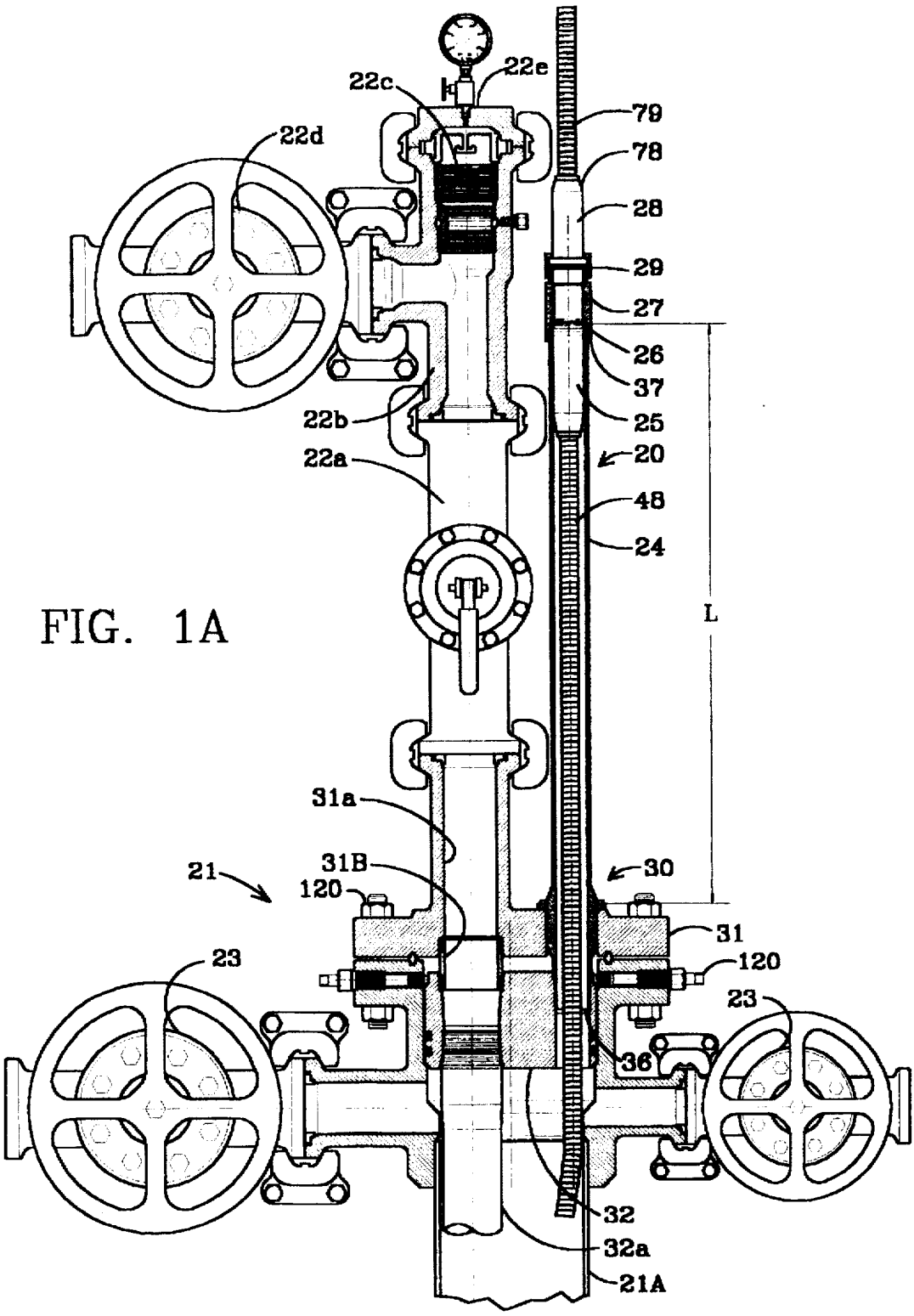
FIG. 1A is a elevational view in cross section illustrating a first embodiment of the elevated electrical connector assembly installed in a wellhead.

This invention is especially useful with wells which run at relatively high temperatures Examples of such wells are hydrocarbon producing wells which have been, or are being, steamed to enhance hydrocarbon production.

Often in such wells it becomes desirable or necessary to assist the hydrocarbon flow to the wellhead with an electric submersible pump. FIGS. 1C and 1D are typical prior art configuration of wellheads having electric connectors 100, 101 and 102 attached to a first wellhead member or tubing hanger 32 and traversing or passing through second wellhead member or bonnet 31. Cable 48 is connected to an electric submersible pump and cable 79 to an electrical power source neither of which is shown in the figures. When a hydrocarbon formation is at an elevated temperature the flowing hot hydrocarbon heats wellhead 21 to a high temperature. As a consequence, lower, middle and upper electrical connectors 100, 101 and 102, respectively, in wellhead 21 are subjected to this high temperature which can, and often does, lead to failure of the electrical connectors. Replacement of heat damaged connectors is a time consuming and costly activity which operators would like to avoid. This invention eliminates electrical connector failure due to prolong exposure to high temperatures.

With reference to FIG. 1A, there is shown a first embodiment of an elevated electrical connector assembly of this invention generally designated by numeral 20 attached to a wellhead 21. In wellhead 21 is a first wellhead member, namely a production tubing hanger, 32 with production tubing **32*a* suspended therefrom. Sleeve 32*b* connects hanger 32 to the vertical passageway section 31*a* of a second wellhead member, namely a bonnet, 31. Connected to the top of section 31*a* is valve 22*a*, tee 22*b* and valve 22*d* all in the hot production flow path. The top of tee 22*b*** is closed with removable plug 22*c* and cap 22*e*. Valves 23 are connected to wellhead 21 which is connected to casing 21A. When wellhead 21 is flowing a hot oil, components 31*a*, 22*a* and 22*b* will also be hot and radiate heat to the surroundings.

Figure 1B:
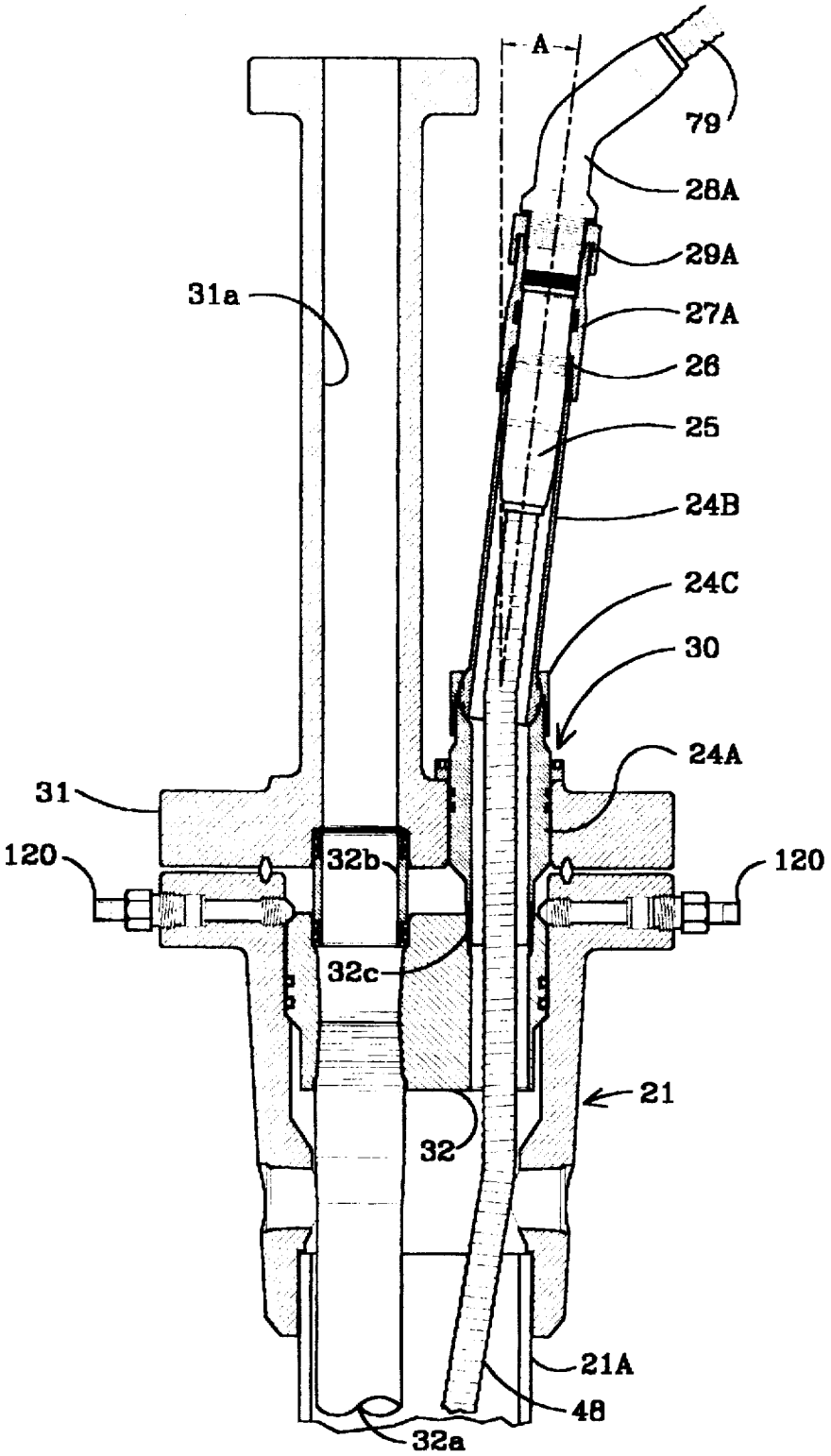
FIG. 1B is a elevational view in cross section illustrating a second embodiment of the elevated electrical connector assembly installed in a wellhead. This embodiment includes a spark containment crossover sealing adapter and tubular assembly housing with swivel.
Figure 1C:
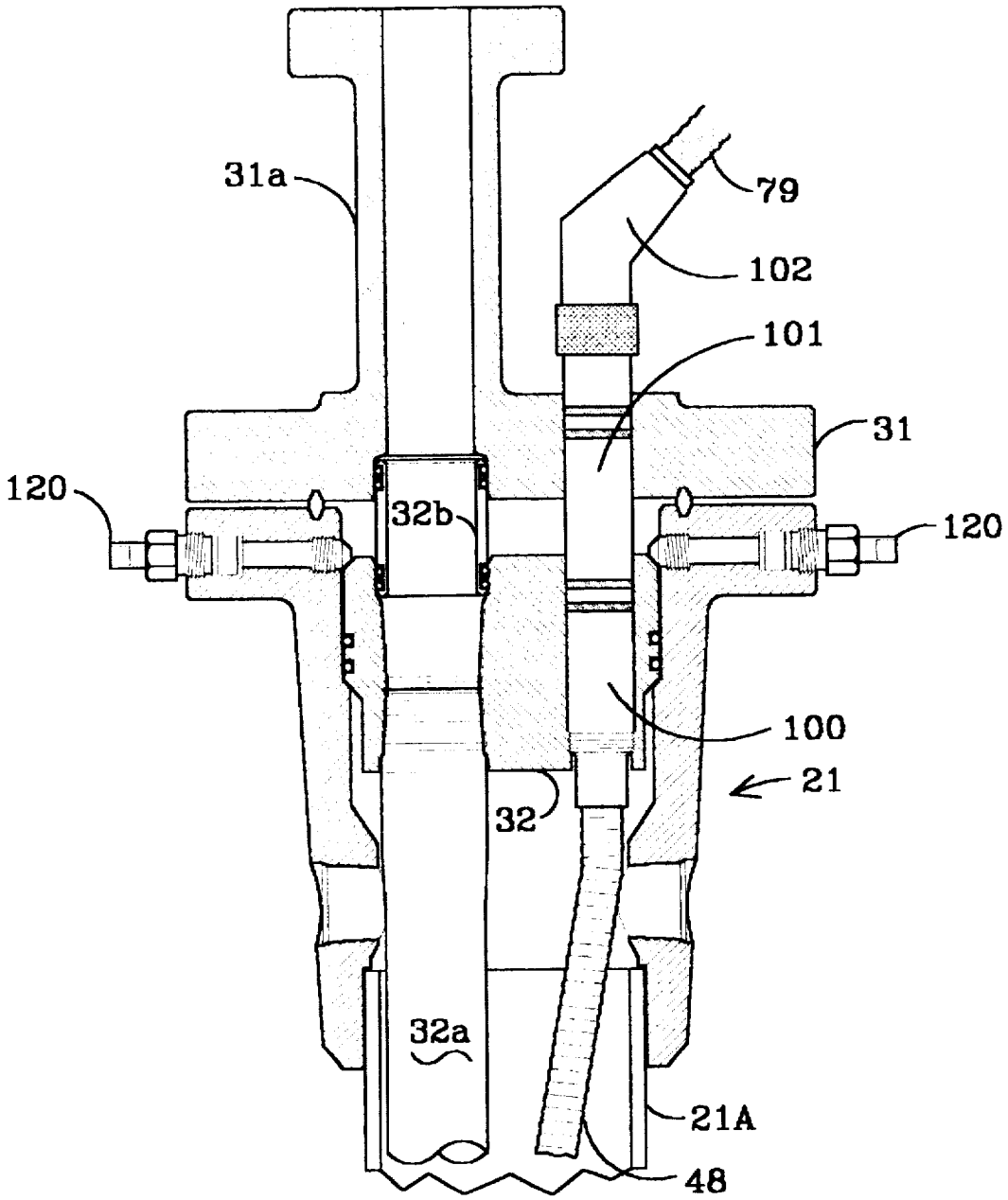
FIG. 1C PRIOR ART
FIGS. 1C and 1D are elevational views in cross section illustrating prior art electrical connector assemblies installed in two different types of wellheads.
Figure 1D:
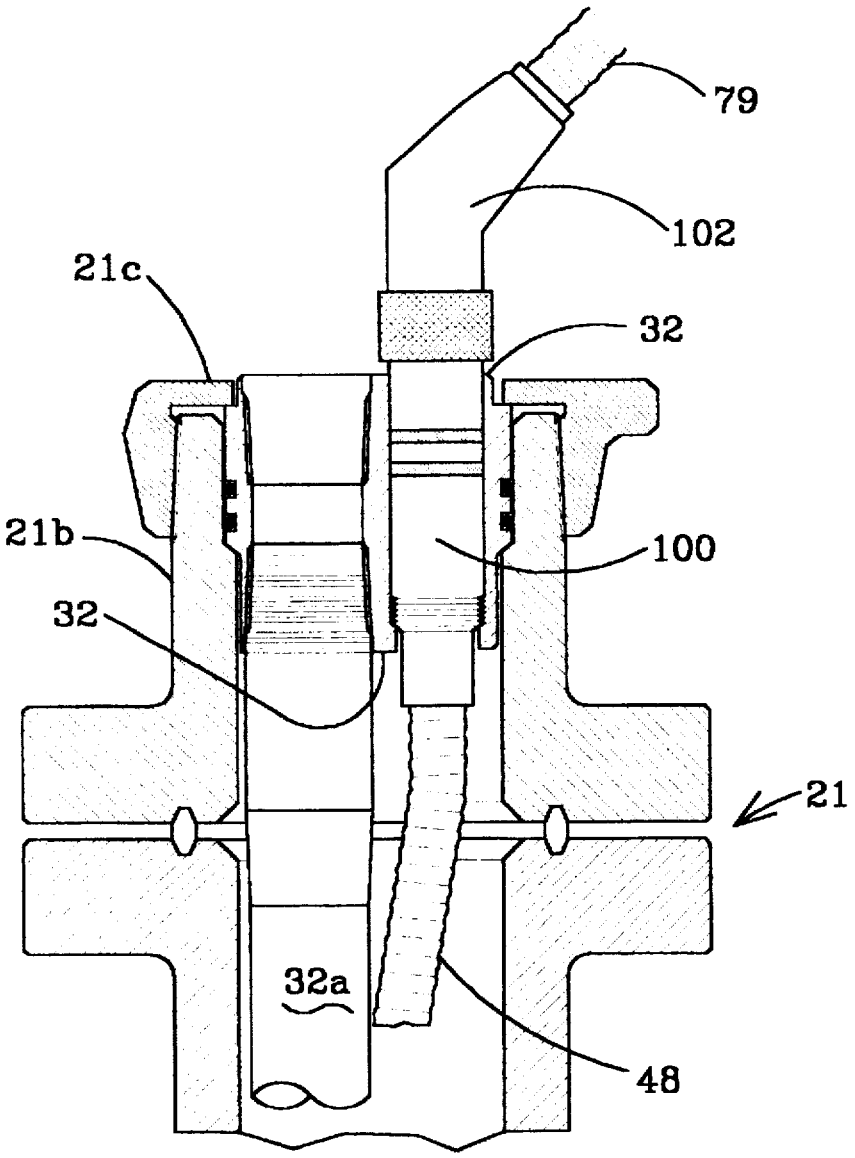
FIG. 1D PRIOR ART

In the past, as shown in FIGS. 1C and 1D, electrical connectors for cable have been located in the wellhead. However, as shown in FIGS. 1A and 1B, by displacing or elevating the electrical connectors 25 and 28 away from the hot wellhead, the ambient air provides sufficient cooling of the elevated electrical connector assembly of this invention to prevent connector failure due to high temperatures. At the same time, maintenance of the well using the elevated electrical connector assembly of this invention is facilitated. For example, in this invention the lower half of elevated electrical connector assembly can be installed, removed and reinstalled through a blowout protector BOP, see FIG. 21.

In the first embodiment shown in FIG. 1A, the elevated electrical connector assembly 20 has a removable tubular assembly housing 24, a removable lower electrical connector 25, a removable annular retainer member 26, a removable crossover sealing adapter 27, a removable upper electrical connector 28, and a removable locking member 29. All of the above-mentioned components are easily removed and reinstalled as will explained below with reference to FIGS. 2–11.

Figure 4:
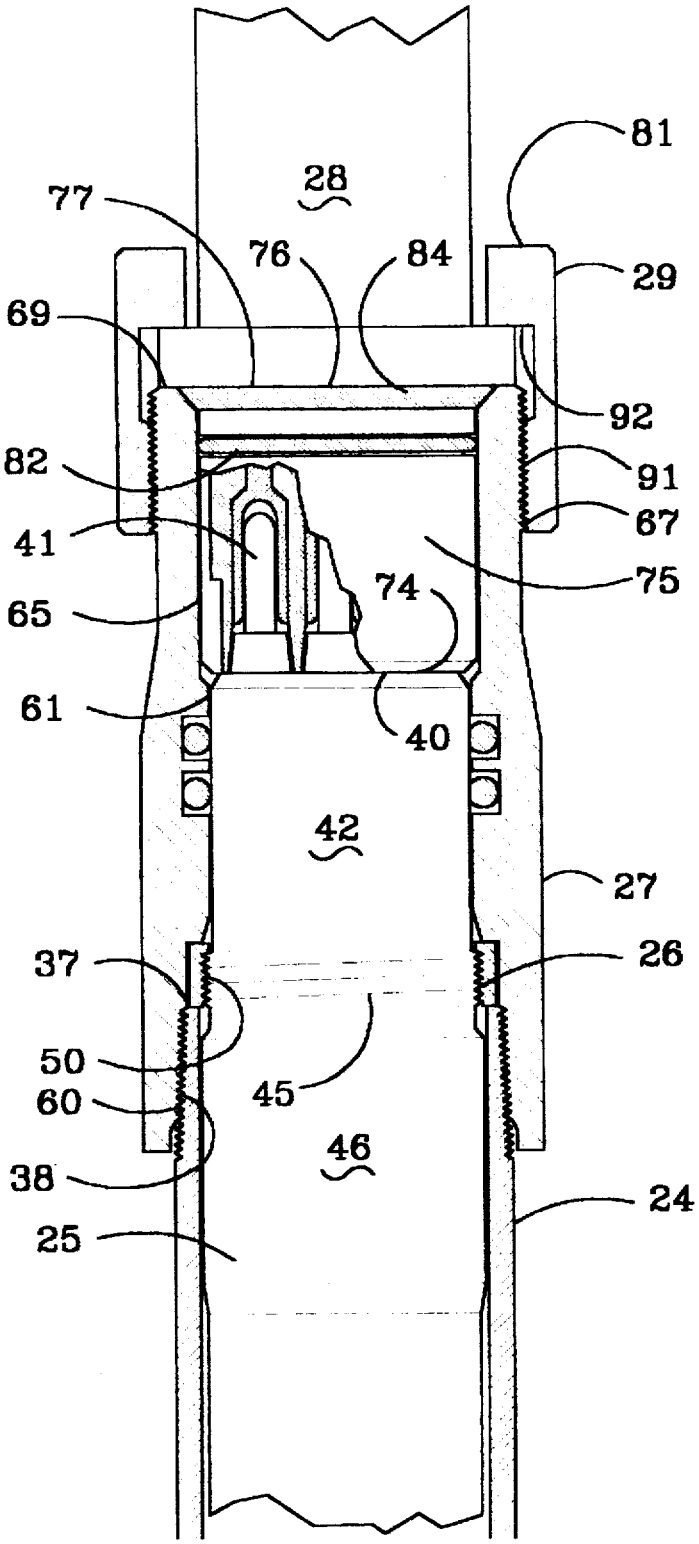
FIG. 4 is a greatly enlarged view of the lower electrical connector and upper electrical connector of FIG. 2.
Figure 2:
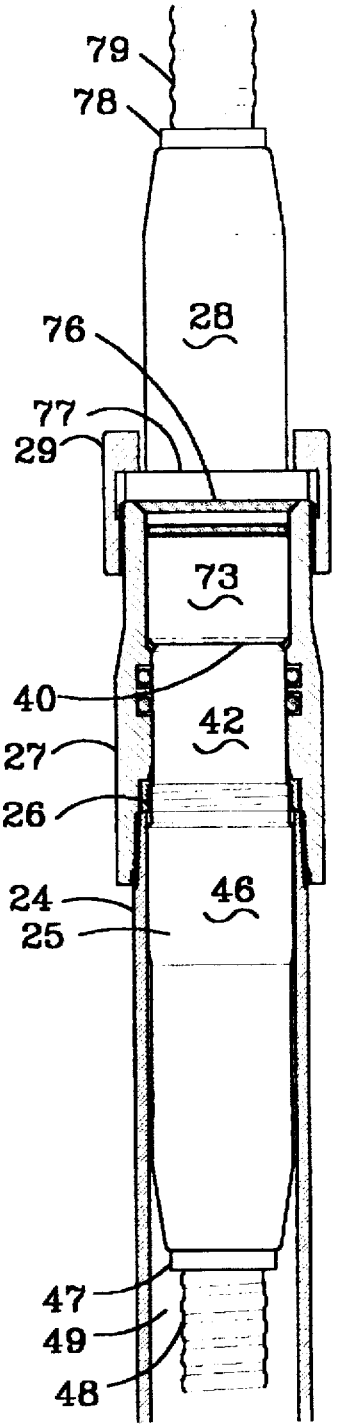
FIG. 2 is an enlarged view of the joint area of the lower electrical connector and upper electrical connector of the connector assembly of FIG. 1A.
Figure 3:
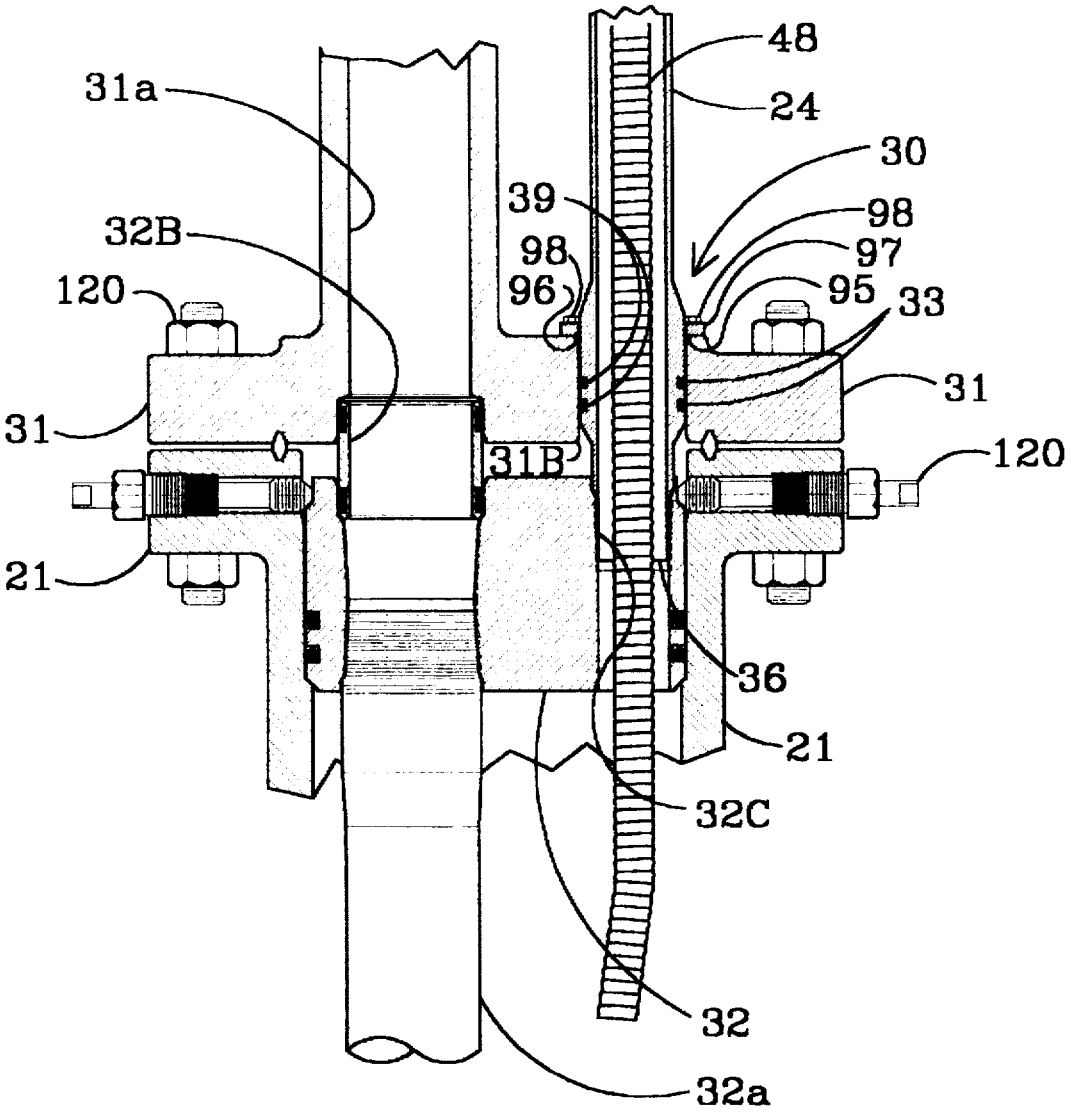
FIG. 3 is a further enlarged view of the pass-through part of the connector assembly of FIG. 1A.
Figure 5:
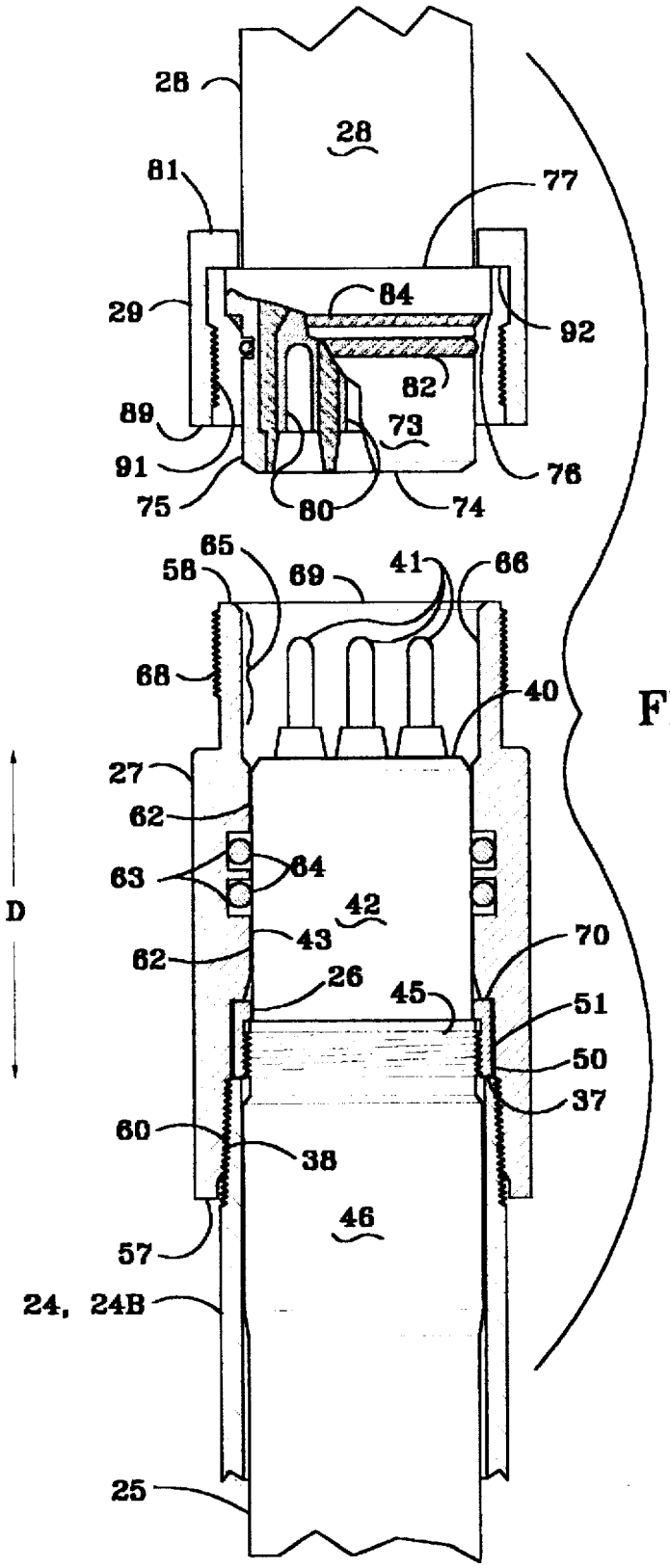
FIG. 5 shows the lower electrical connector and upper electrical connector of FIG. 4 when completely separated.

FIG. 2 is an enlarged view of the area of connection of the upper electrical connector 28 to the lower electrical connector 25. FIG. 4 is a still greater enlargement of this area. FIG. 5 shows upper electrical connector 28 separated from lower electrical connector 25. FIG. 3 shows an enlarged view of a pass-through part 30 of the tubular assembly housing 24. Pass-through part 30 traverses second wellhead member or bonnet 31 through bore 318 and is screwed into first wellhead member or tubing hanger member 32. Pass-through part 30 can be sealed by O-ring seals 33 in inner circumferential recesses 39 in pass-through part 30 as shown in FIG. 1, or alternately by O-ring seals (not shown in drawings) in inner circumferential recesses in bore 31B of bonnet 31. In either embodiment, bonnet 31 may also, or alternatively, contains internal conical surface 95 in which another O-ring seal 96 is sandwiched between internal conical surface 95 and split annular member 97 which is bolted with bolts or other fastener means 98 to bonnet 31 thereby providing additional means for preventing leakage between pass-through part 30 and bonnet 31.

Figure 6:
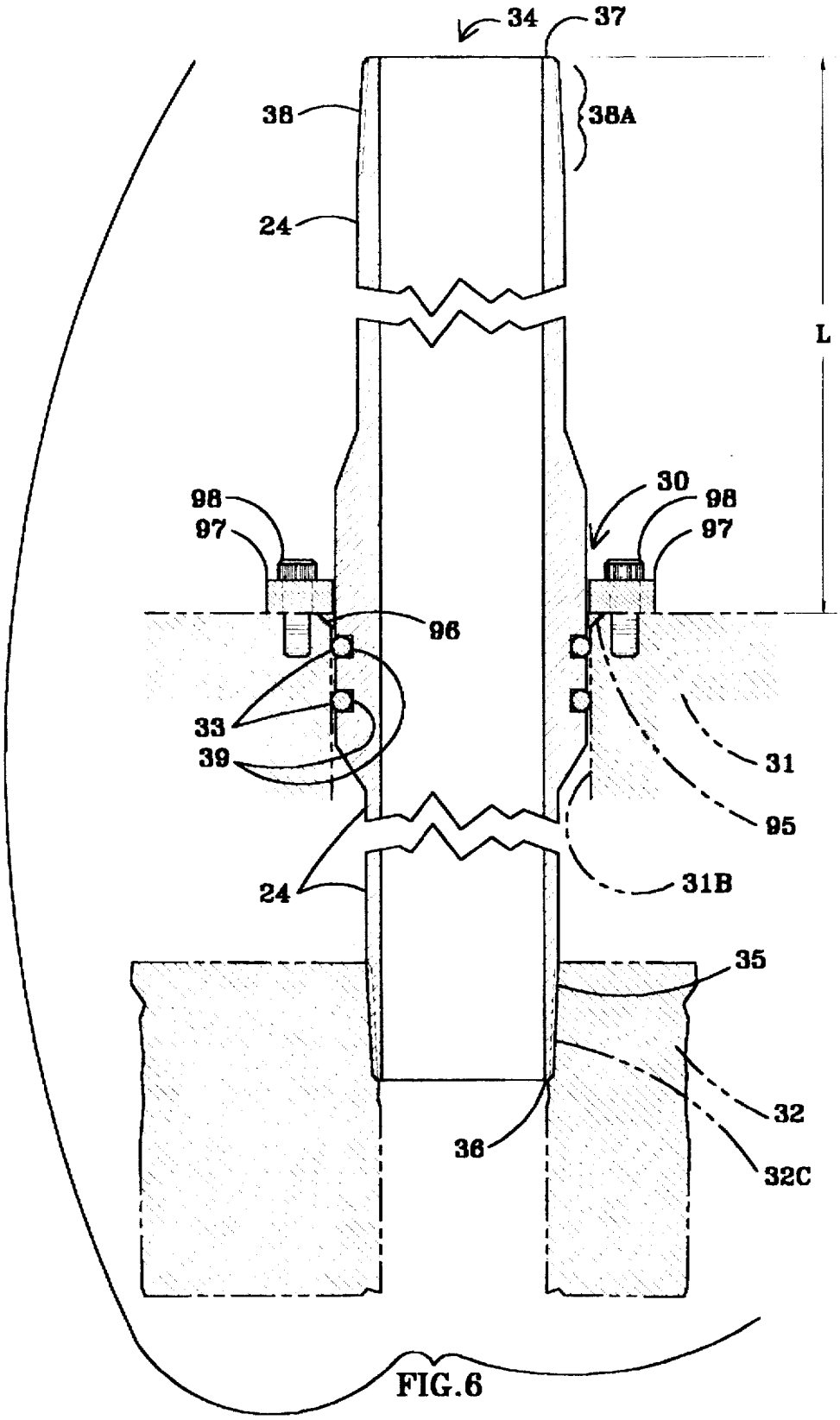
FIG. 6 shows details of the tubular assembly housing of FIG. 1A in cross section in a first and second wellhead members.

FIGS. 6–11 show the several components of the elevated electrical connector assembly separated. In particular, FIGS. 6 and 3 show tubular assembly housing 24 in cross section. Housing 24 is tubular with housing passageway 34. An externally threaded section or threaded first means 35 on end 36, i.e. the housing lower connecting end, provides means for attaching to threaded bore 32C in first wellhead member 32, which also serves as a production tubing hanger. The other end, end 37, of housing 24, i.e. the housing upper connecting end, also has an externally threaded coupling first part 38.

Figure 7:
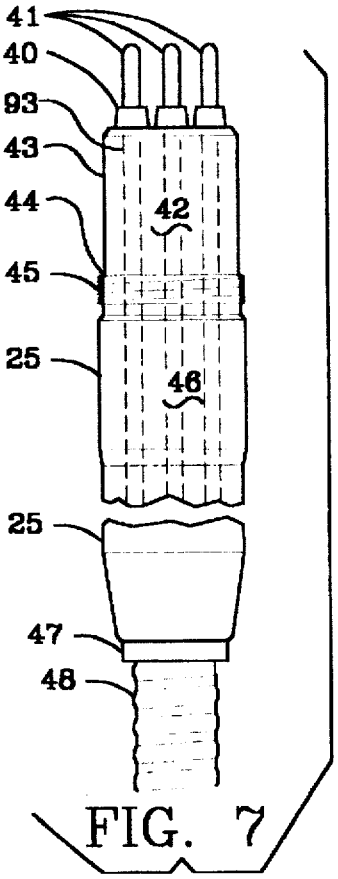
FIG. 7 shows details of the lower electrical connector of FIG. 1A.
Figure 16:
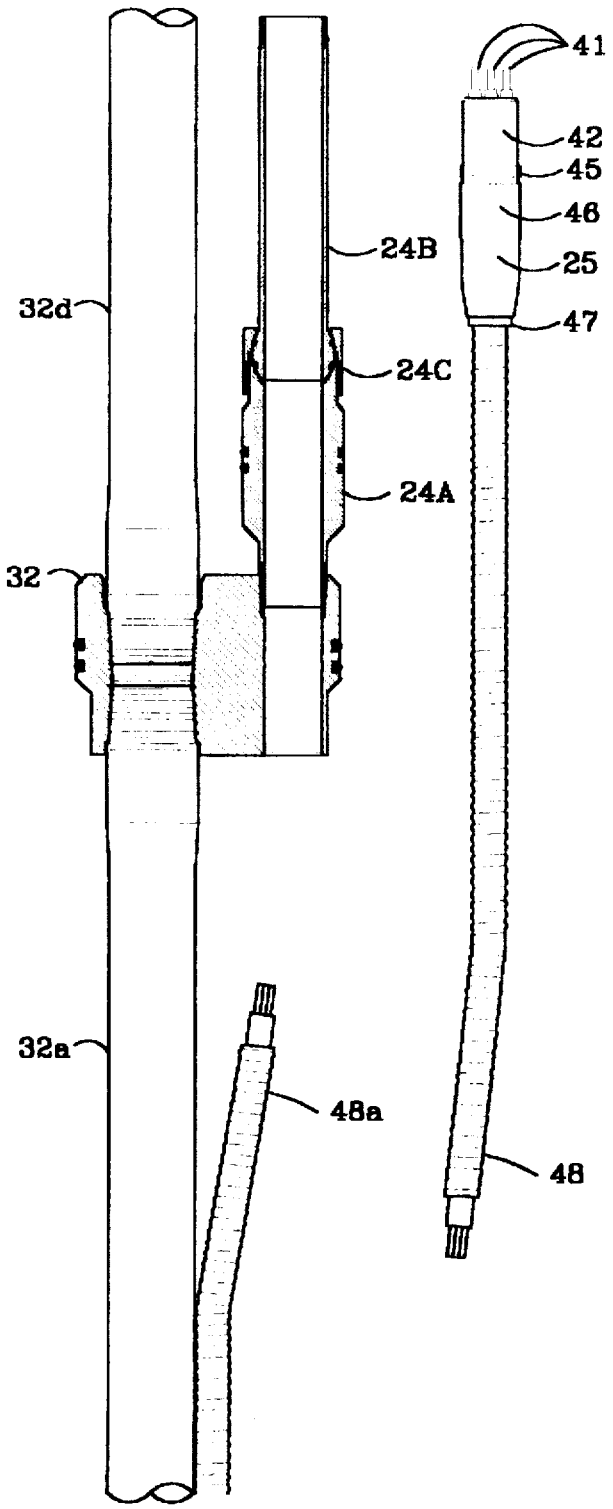
FIGS. 16–20 show sequential steps for installing the upper electrical connector, annular retainer member and crossover sealing adapter in the housing shown in FIG. 15.

Lower electrical connector 25, shown in FIG. 2, is insertable through housing 24 with annular clearance 49 therebetween becoming smaller in segments as top or upper end 40 is neared. With reference to FIG. 7, starting with upper end 40, lower electrical connector 25 has protruding conductors or prongs 41 extending from an upper cylindrical upper first section 42 with a cylindrical surface 43, an external shoulder 44, an externally threaded supporting second section 45, another cylindrical section 46 of larger diameter than section 42, and lower cable-connecting end 47 attached to a cable 48 below section 46. Cable 48 has a length convenient for splicing to a long length of electrical cable 48*a* (FIG. 16) connected to a downhole electric submersible pump (not shown in the drawings). For example, cable 48 of lower electrical connector 25 can be spliced to the longer length of cable 48*a* connected to the electric submersible pump before lower electrical connector 25 is installed in tubular assembly housing 24.

Figure 8:
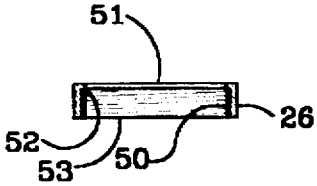
FIG. 8 shows details of the annular retainer means of FIG. 1A in cross section.

Annular retainer member 26, shown in FIG. 8, has an internally threaded supporting second means 50 which screws onto externally threaded supporting second section 45 of lower electrical connector 25 thereby providing means for maintaining the cylindrical upper first section 42 of the lower electrical connector 25 outside the tubular assembly housing 24 a predetermined distance, D, (see FIG. 5) from upper connecting end 37 of housing 24 or 24A, and means for preventing lower electrical connector 25 from slipping through housing 24 and falling into the well. Annular retainer member 26 has an upper flat surface 51, internal shoulder 52, and lower flat surface 53.

Figure 9:
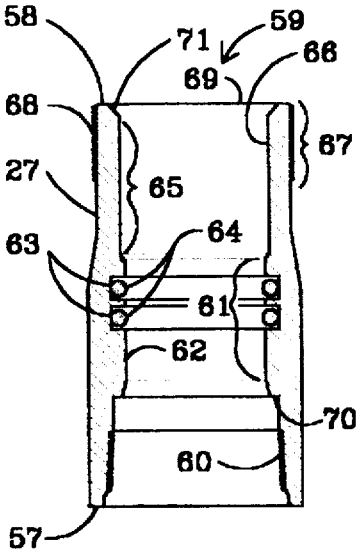
FIG. 9 shows details of the crossover sealing adapter of FIG. 1A in cross section.
Figure 10:
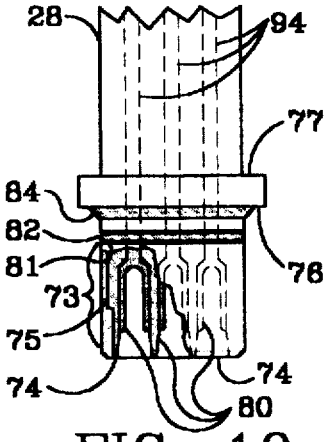
FIG. 10 shows details of the lower end of the upper electrical connector of FIG. 1A.

Crossover sealing adapter 27, shown in FIG. 9, has a first or adapter lower end 57, a second end or adapter upper end 58, and an adapter passageway 59 therebetween. Threaded coupling third means 60 having an internally threaded section, near adapter lower end 57, screws onto externally threaded coupling first part 38 of tubular assembly housing 24 thereby providing means for connecting adapter 27 to housing 24. Above section 60, adapter passageway has a bored first portion 61 which has an internal cylindrical surface 62 that is slidable over the cylindrical upper first section 42 of the lower electrical connector 25. Portion 61 contains two spaced apart inner circumferential recesses 63 for supporting O-ring seals 64. O-rings 64 and recesses 63 provide sealing fourth means for preventing leakage between the bored first portion 61 and the cylindrical upper first section 42 of the lower electrical connector. In adapter passageway 59, between upper end 58 and bored first portion 61 is a bored second portion 65 which has internal cylindrical surface 66. On the outside of crossover sealing adapter 27 and near its upper end 58, is a coupling third portion 67 with external threads 68. A flat surface 69 runs across upper end 58.

Between the bored first portion 61 and internally threaded section 60 there is an internal shoulder 70 which abuts the upper flat surface 51 of annular retainer member 26, thereby fixing the location of end 40 of lower electrical connector 25 within crossover sealing adapter 27. It can be seen that upon each and every reassembly of lower electrical connector 25, tubular assembly housing 24, annular retainer member 26, and crossover sealing adapter 27, the location of end 40 in the adapter 27 will always be exactly the same, and distance D will always be the same. Between bored second portion 65 and upper end 58 is an internal conical surface 71 for abutting seal 84.

Upper electrical connector 28, shown partly in FIG. 1D, has a cylindrical lower sector 73 with an external cylindrical surface 75 near first or lower end 74. Cylindrical surface 75 is insertable into the internal cylindrical surface 66 of bored second portion 65 of crossover sealing adapter 27. Above lower sector 73 is lower external shoulder 76 which upon assembly abuts upper flat surface 69 of crossover sealing adapter 27. Above shoulder 76 is upper external shoulder 77 which, when the elevated electrical connector assembly is assembled, abuts internal shoulder 92 of annular locking member 29. The other or second end, i.e. upper end 78, of upper electrical connector 28 is connected to a convenient length of cable 79 for splicing to an electrical cable connected to a power source (not shown in the drawings).

Lower sector 73 contains an inner circumferential recess 81 for supporting O-ring seal 82. O-ring 82 provide means for preventing leakage between the lower sector 73 and the bored second portion 65 of tubular assembly housing 24. Between recess 81 and lower external shoulder 76 is an external conical surface under which another O-ring seal 84 is sandwiched between such external conical surface and internal conical surface 71 of crossover sealing adapter 27. Seal 84 provides additional or alternative means for preventing leakage between the lower sector 73 and assembly crossover sealing adapter 27.

Figure 11:
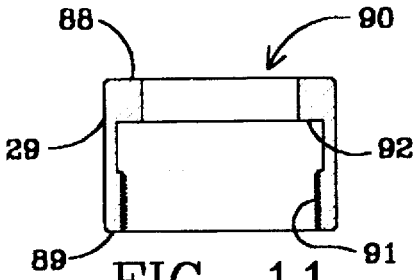
FIG. 11 shows details of the locking means of FIG. 1A in cross section.

Locking member 29, shown in FIG. 11, is used to securely fasten upper electrical connector 28 to lower electrical connector 25. Locking member 29 has a first or upper end 88, a second or lower end 89 and a passageway 90 therebetween. Internally threaded coupling means 91, near end 89, screws onto externally threaded coupling portion 67 of crossover sealing adapter 27 until internal shoulder 92 abuts upper external shoulder 77 of upper electrical connector 28, thereby providing coupling means for maintaining lower end 74 of the upper electrical connector 28 in abutting relationship with upper end 40 of the lower electrical connector 25. When installing at the wellhead, locking member 29 is first slid over the convenient length of cable 79 attached to upper electrical connector 28, then the cable is spliced to an electrical cable leading to a power source.

Within both lower electrical connector 25 and upper electrical connector 28 are a plurality of shielded electrical conductors, 93 and 94, respectively, which in the embodiment illustrated is three. Prongs 41 of lower electrical connector 25, which are connected to shielded electrical conductors 93, engage sockets 80 of upper electrical connector 28, which are connected to shielded electrical conductors 94. Socket 80 provides contact means for making electrical connection between conductors 93 and 94 The internal construction of the connectors can be the same as that described in U.S. Pat. No. 4,708,201 which is hereby incorporated herein by reference. The reader is particularly referred to FIG. 5 of U.S. Pat. No. 4,708,201.

A very important advantage of the elevated electrical connector assembly of this invention is that the lower electrical connector and cable can be feed up through the bottom of the tubing hanger into the tubular assembly housing and anchored in place, see FIGS. 16–20. This allows the tubing hanger to be removed without cutting the electric cable below the lower electrical connector. As a consequence when reinstalling the tubing hanger the electric cable does not have to be respliced thereby saving considerable time and materials. It is believed that the time saved is about 4 to 6 hours. This advantage by itself makes the elevated electrical connector assembly useful for many wells regardless of whether or not the wells are operating at an elevated temperature.

When the upper electrical connector is disconnected, as shown in FIG. 5, a cap 72 (FIGS. 20–24) is screwed onto upper end 58 of adapter 27 to protect prongs 41 and threaded coupling portion 67 until the upper electrical connector is installed.

Figure 12:
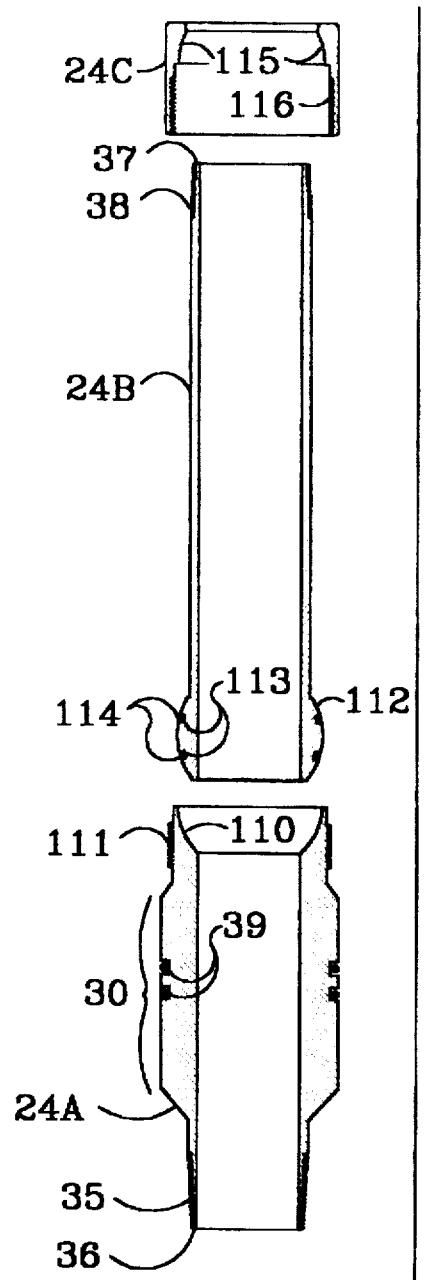
FIG. 12 is an exploded view in cross section of the tubular assembly housing with swivel of the elevated electrical connector assembly of FIG. 1B.
Figure 13:
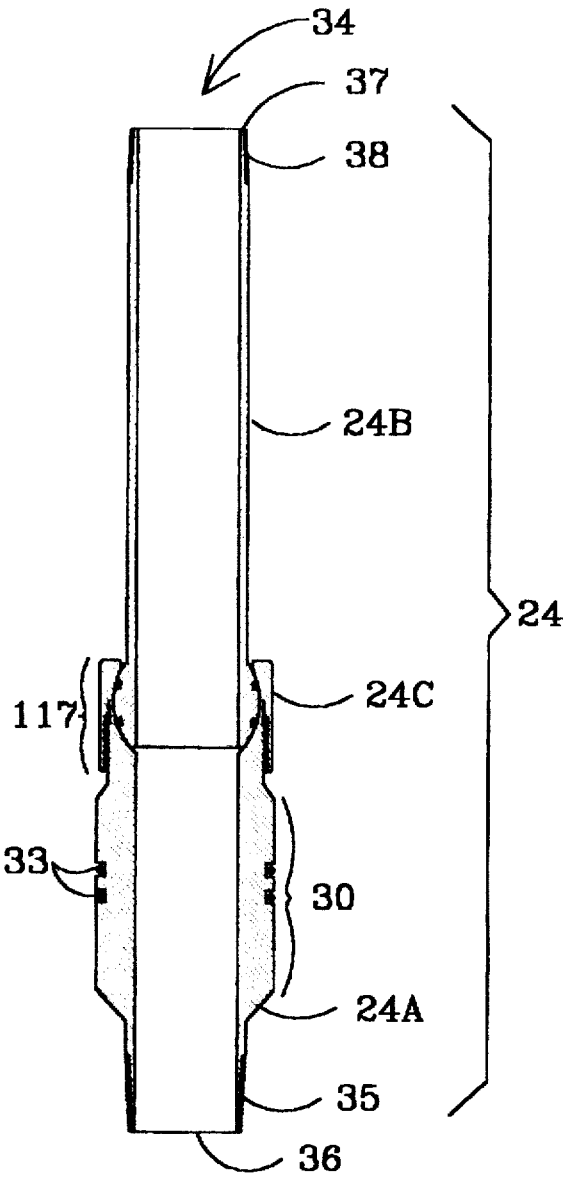
FIG. 13 is the tubular assembly housing of FIG. 12 assembled.

FIG. 1B illustrates a second embodiment of this invention which features a swivel means in the tubular assembly housing and spark containment means when making or breaking electrical contact between the upper and lower electrical connectors. Referring to FIGS. 1B, 12 and 13, tubular assembly housing 24 comprises lower part 24A, upper part 24B and coupling part 24C. Lower part 24A comprises lower end 36, externally threaded section 35, pass-through part 30 with recesses 39 with seals 33, concave spherical surface 110, and externally threaded section 111. Upper part 248 comprises upper end 37, externally threaded section 38, and convex spherical surface 112 with outer circumferential recesses 113 supporting O-ring seals 114. Coupling part 24C comprises adjunct concave spherical surface 115 and internally threaded section 116. Tubular assembly housing parts 24A, 24B and 24C form a ball and socket coupling 117 which can be swiveled through variable angle A away from hot component **31*a* in the production flow path and attached to wellhead 21**.

Figure 14:
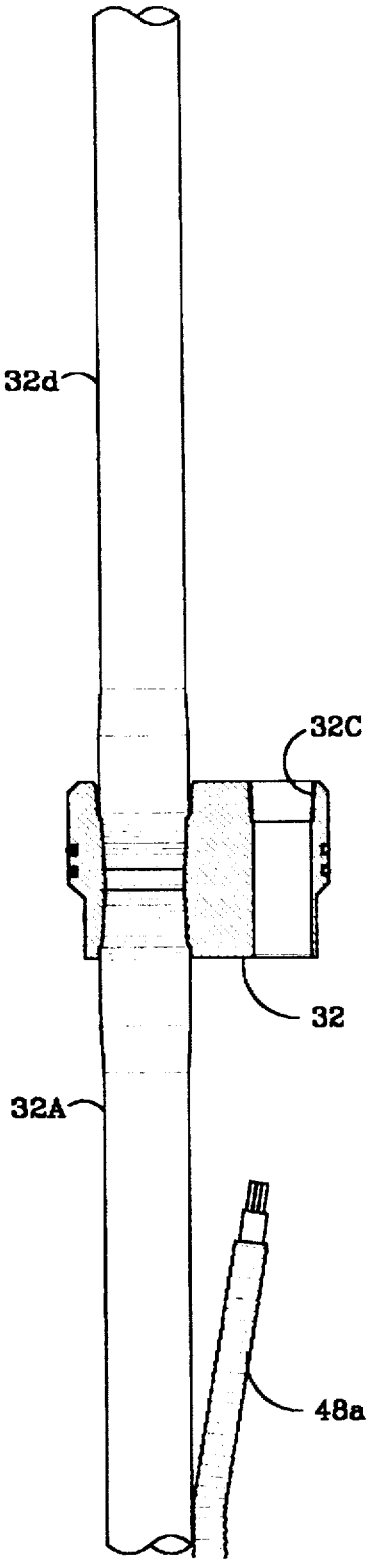
FIG. 14 is cross-sectional view a tubing hanger with production tubing, electric cable and support pipe.
Figure 15:
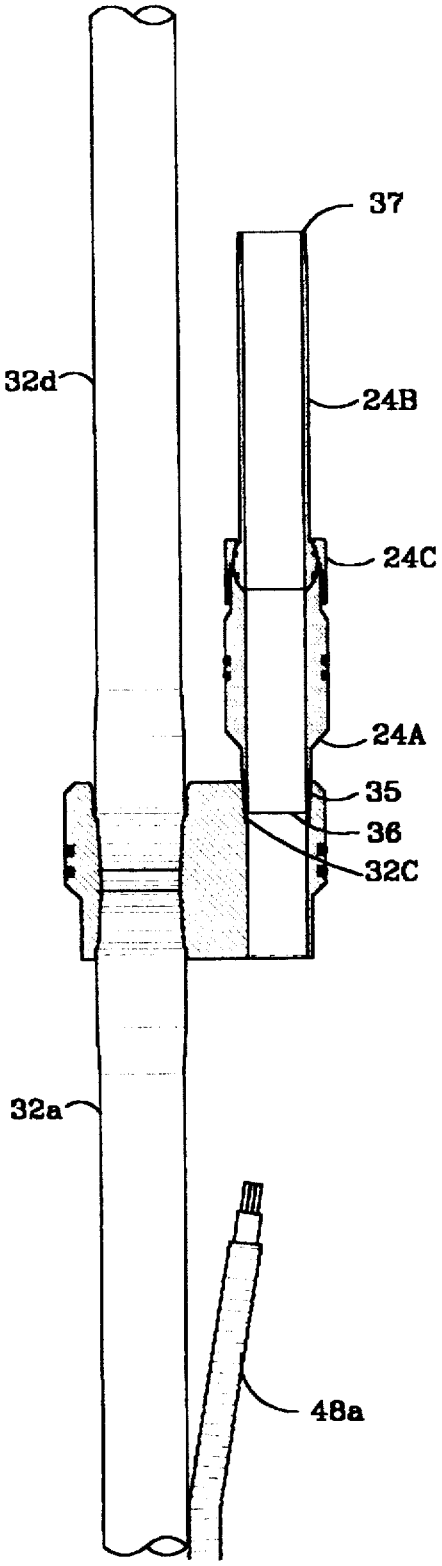
FIG. 15 is the tubular assembly housing of FIG. 13 installed in the tubing hanger of FIG. 14.
Figure 17:
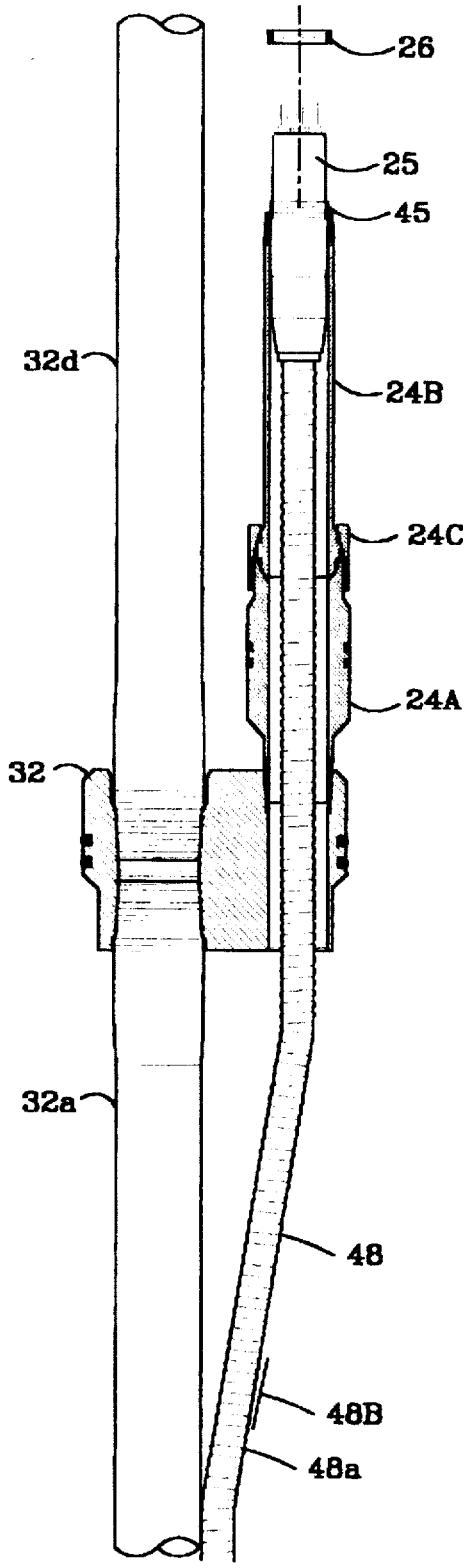
Figure 18:
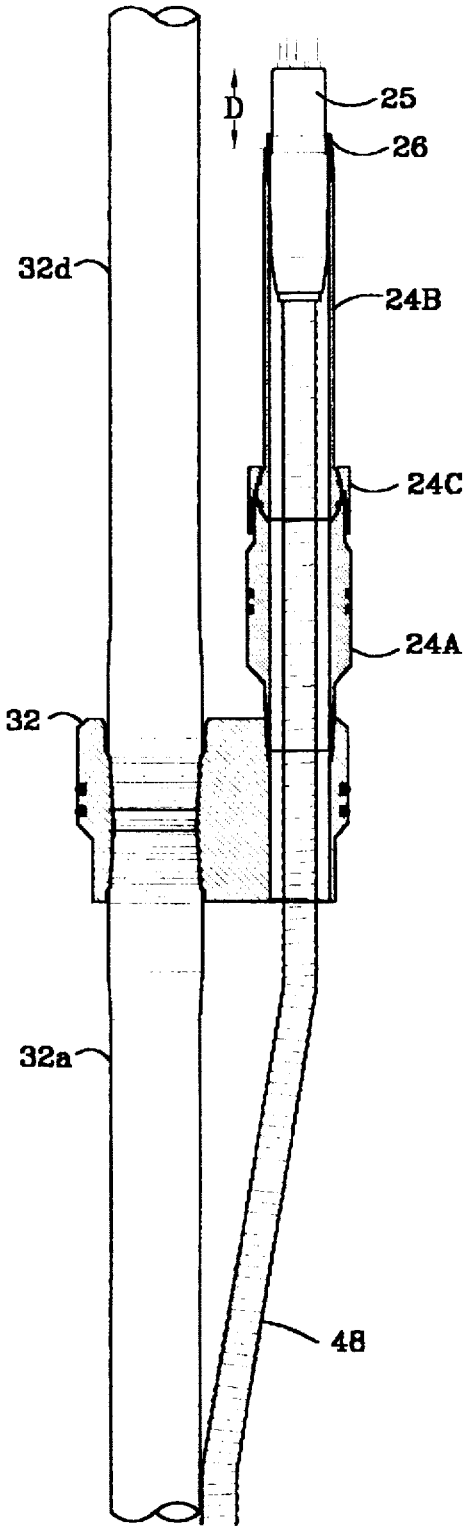
Figure 19:
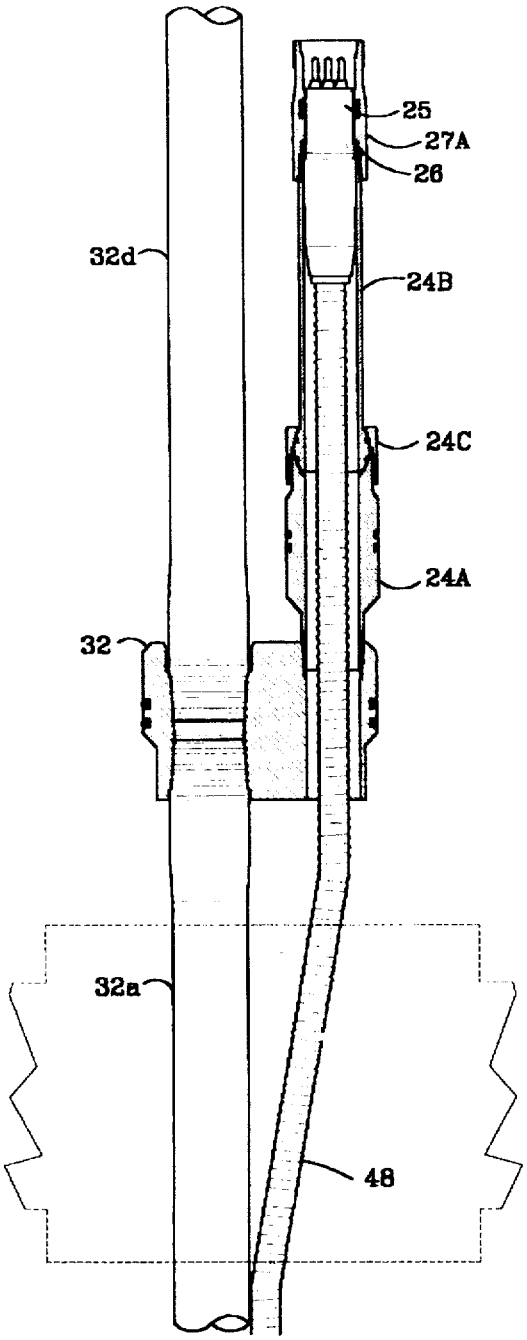
Figure 20:
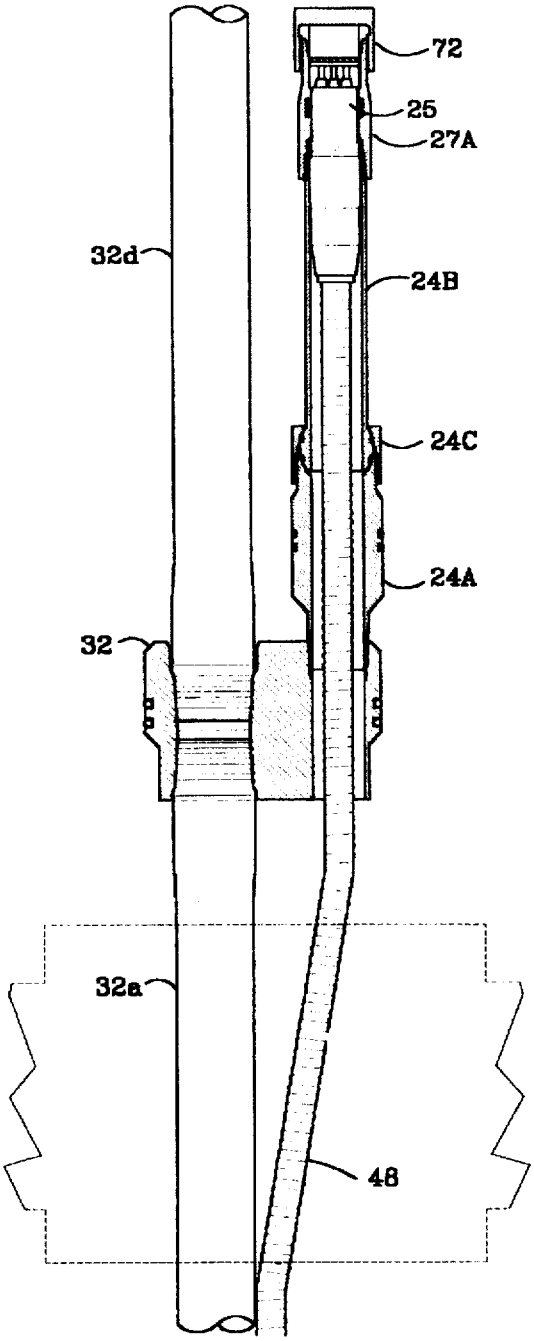
Figure 21:
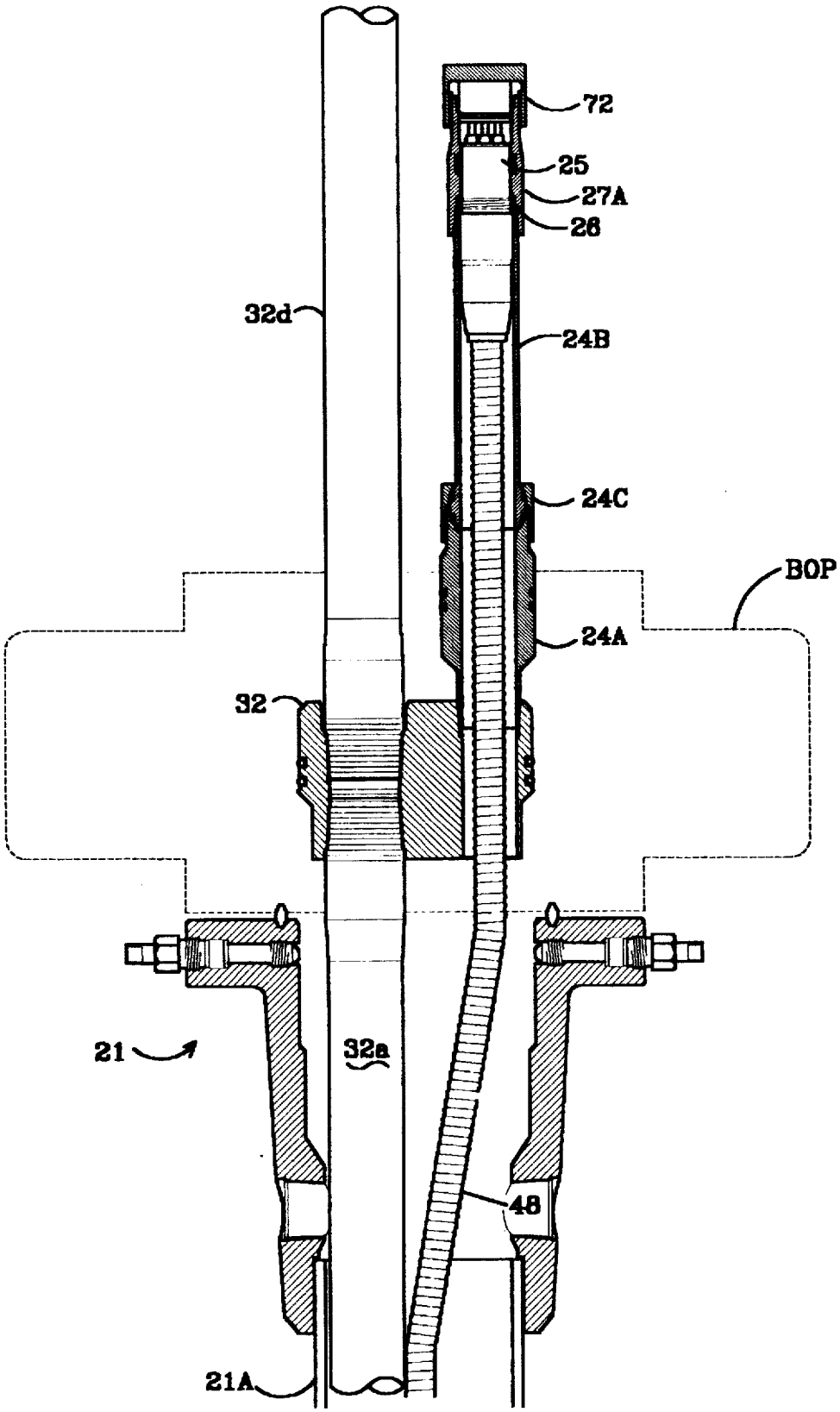
FIG. 21 shows the next step after FIG. 20 of installing the assembly of FIG. 20 in a wellhead through a blowout protector mounted on the wellhead.

The assembled tubular assembly housing 24 (shown in FIG. 13) can be installed in tubing hanger 32 (shown in FIG. 14) suspended from suspension tubing **32*d* and supporting production tubing 32*a* and power cable 48*a* as shown in FIG. 15. Lower electrical connector 25 with a short length of cable 48 (shown in FIG. 16) can be spliced to long cable 48*a* which is connected to a downhole electric submersible pump (not shown) as shown in FIG. 17. Annular retainer member 26 can then be screwed onto externally threaded section 45 of lower electrical connector 25 as shown in FIG. 18. Crossover sealing adapter 27A can then be screwed onto externally threaded section 38 of tubular assembly housing part 248 thereby sealing lower electrical connector 25 in crossover sealing adapter 27A as shown in FIG. 19. A temporary protective cap 72 is then installed on the top of crossover sealing adapter 27A to protect the lower electrical connector from the environment as shown in FIG. 20. The tubing hanger 32 is then lowered in wellhead 21 through blowout protector "BOP" as shown in FIG. 21**.

Figure 22:
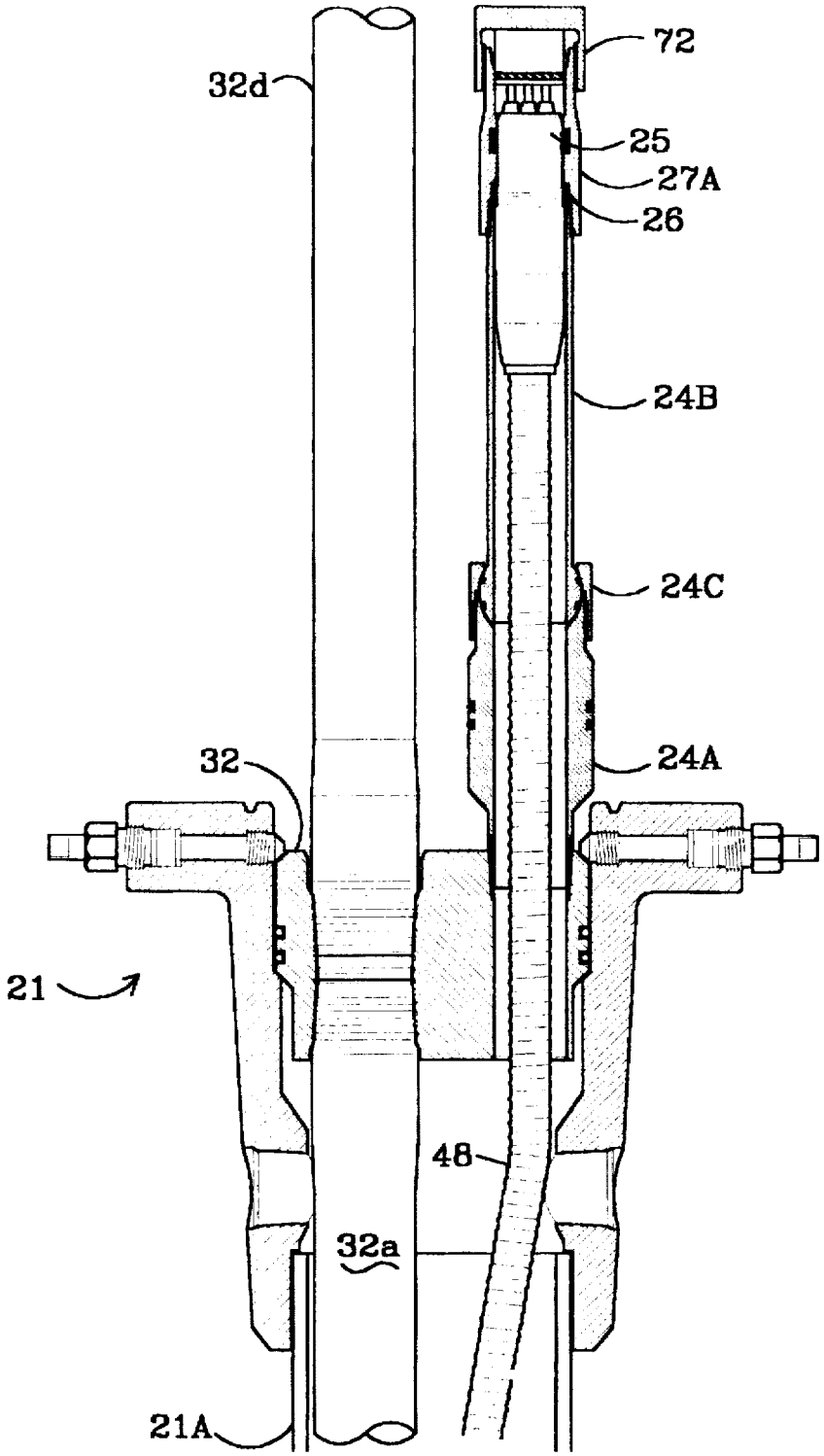
FIGS. 22–24 show sequential steps for landing the partially assembled assembly of FIG. 21 in the wellhead, installing the bonnet, and swiveling the upper end of the tubular assembly housing away from the components connected to the wellhead.
Figure 23:
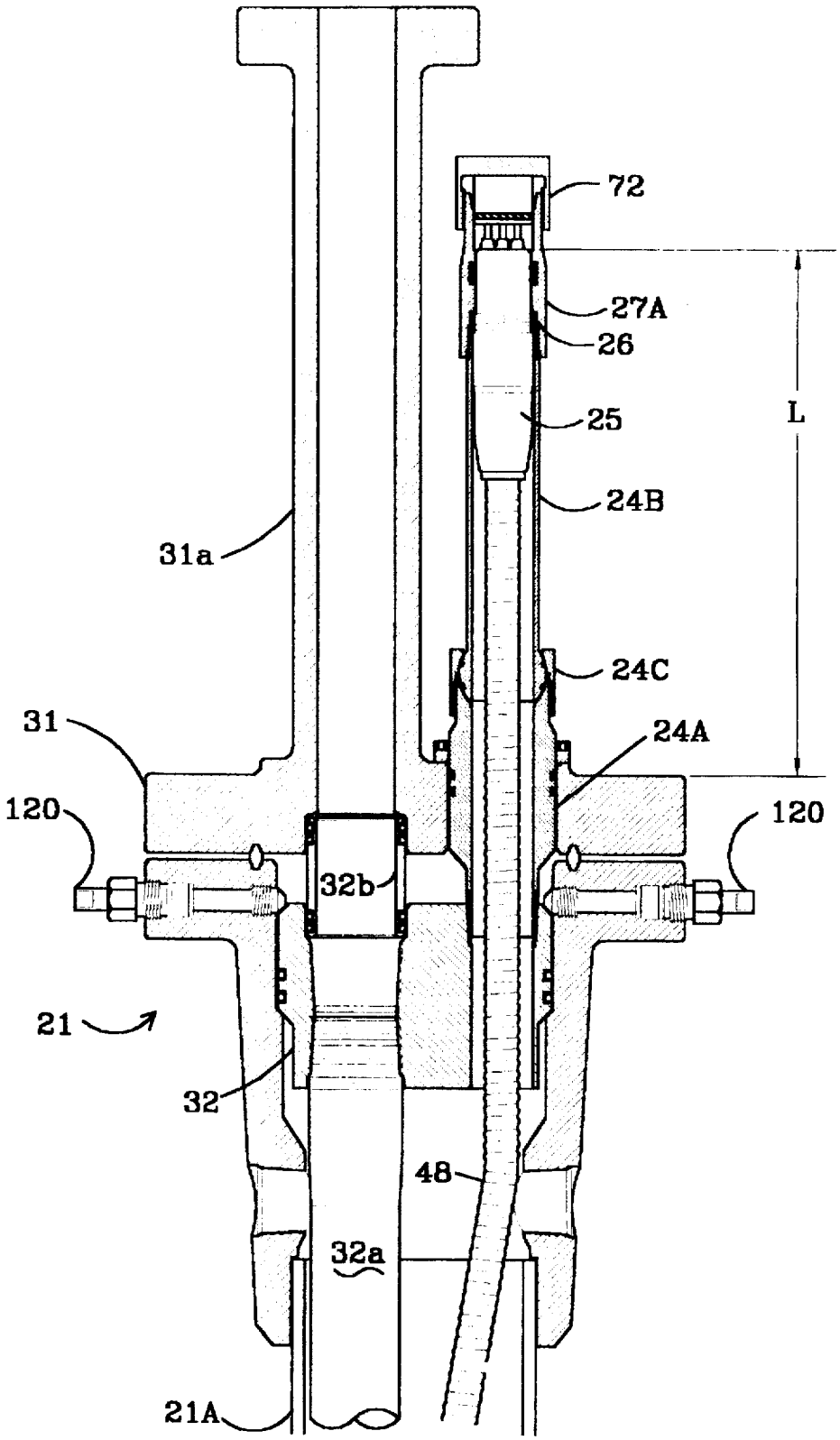
Figure 24:
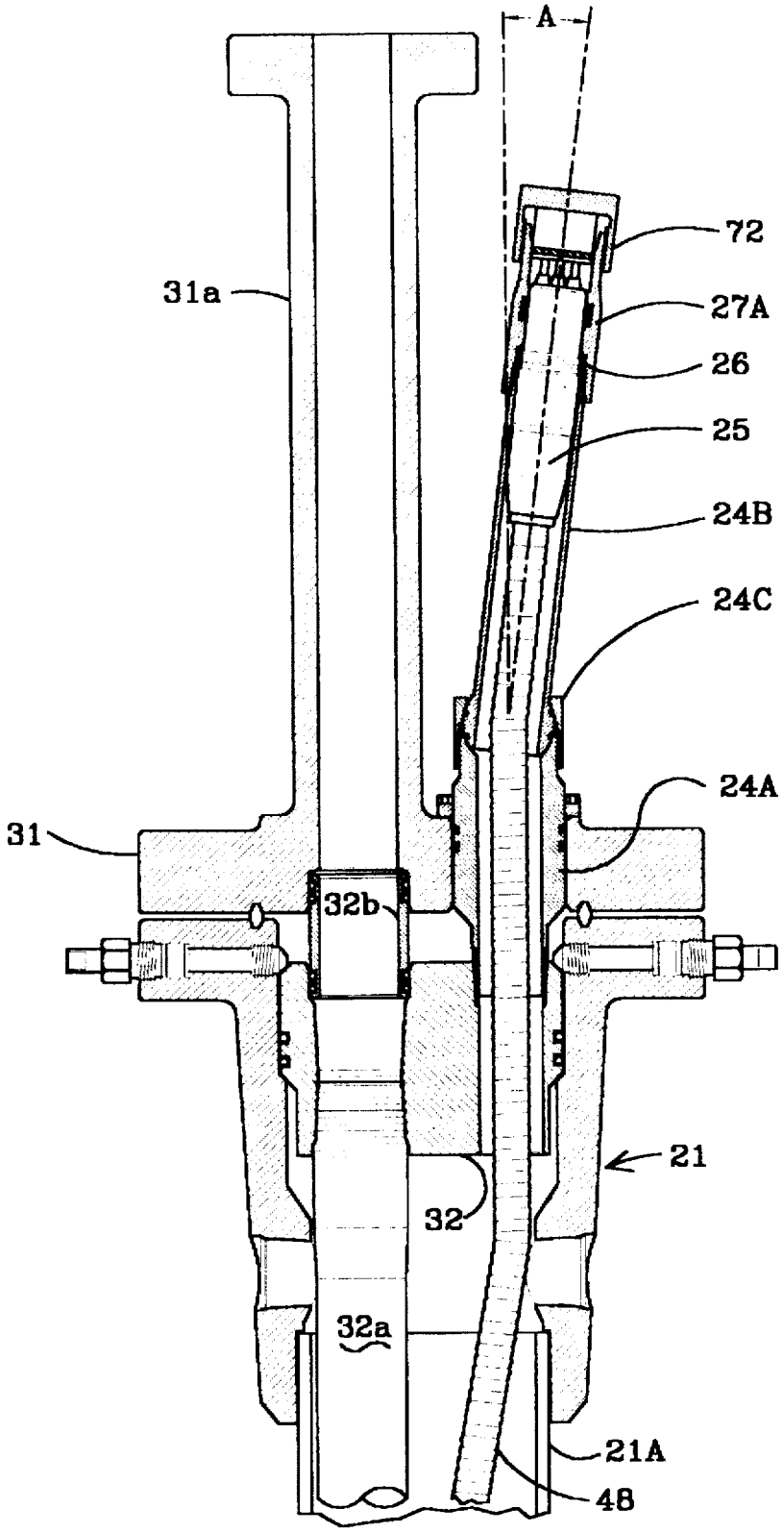

Tubing hanger 32 is locked into wellhead 21 with locking screws 120 and the BOP removed as shown in FIG. 22. Suspension tubing **32*d* is then removed and other wellhead components installed, if not previously installed, as shown in FIGS. 23 and FIG. 1A. Tubular assembly housing part 24C can be loosened enough to permit upper part 248 to be tilted away from hot component 31*a* as illustrated by angle A in FIG. 24. Cap 72 is then removed and upper electrical connector 28A connected to lower electrical connector as shown in FIG. 1B**.

Figure 25:
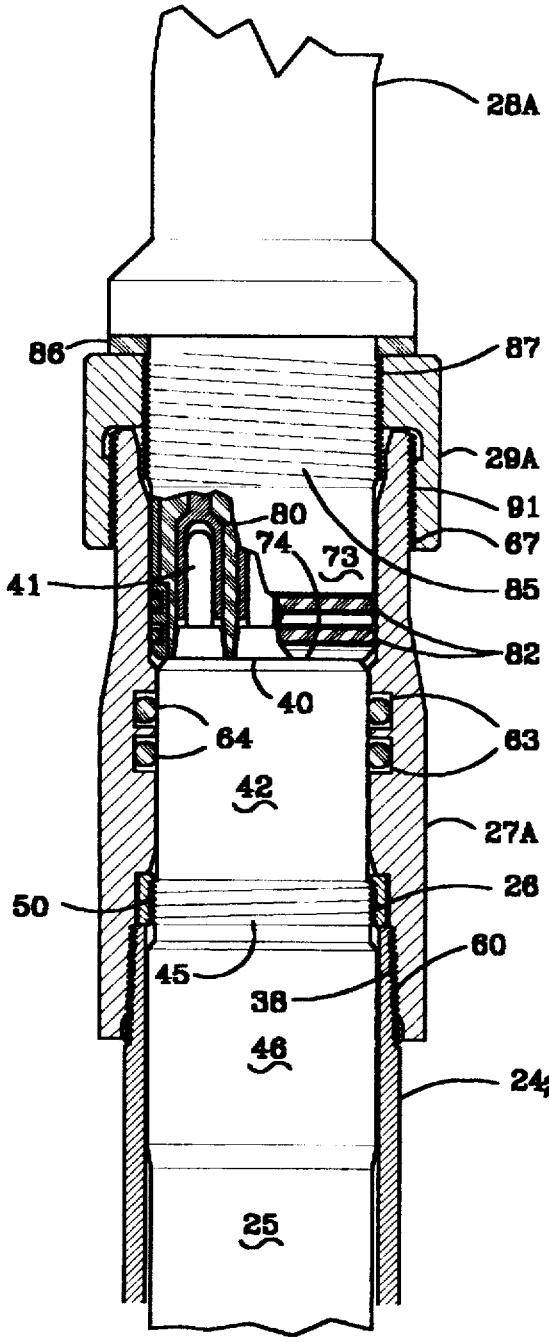
FIG. 25 shows the installation of the upper electrical connector on the assembly of FIG. 24.
Figure 26:
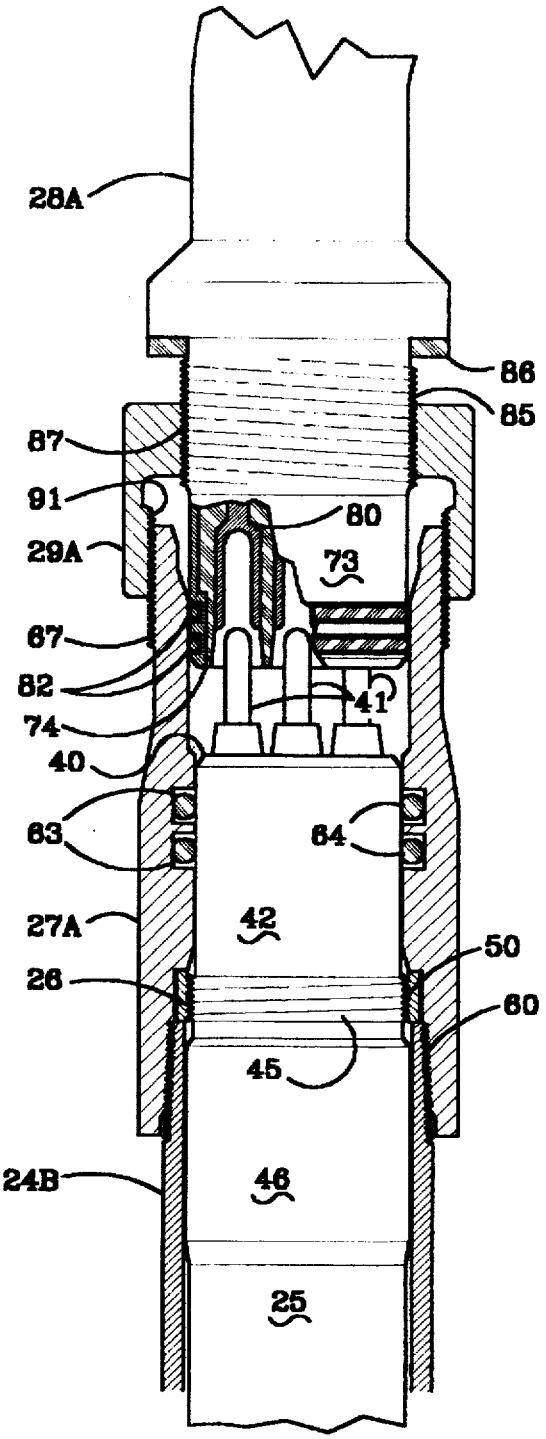
FIG. 26 shows details of the spark containment features when electrical contact is broken in the elevated electrical connector assembly of FIG. 25.

Another characteristic of this invention is the spark containment feature of crossover sealing adapter 27A, upper electrical connector 28A and annular locking member 29A as illustrated in FIG. 1B and greatly enlarged FIGS. 25 and 26. Annular locking member 29A contains internally counter-threaded section 87 which screws onto externally counter-threaded section 85 of upper electrical connector 28A. As internally threaded section 91 of annular locking member 29A is screwed onto externally threaded section 67 of crossover sealing adapter 27A, internally counter-threaded section 87 of crossover sealing adapter 27A is simultaneously screwed onto externally counter-threaded section 85 of upper electrical connector 28A. For example, if threaded sections 67 and 91 are right hand threads then threaded sections 67 and 91 will be left hand threads. If all threads are the same pitch, then for every rotation of annular locking member 29A, upper electrical connector 28A is drawn two threads closer to, or farther from, lower electrical connector 25. As can be seen in FIG. 26, just before electrical connection between upper and lower electrical connectors is broken or made, annular locking member 29A is still thread-connected to crossover sealing adapter 29A by several threads, preferably at least about 10 threads. Thus, if a spark is generated by the breaking or connecting of the upper and lower electrical connectors, the spark will be completely contained within the electrical connector assembly thereby preventing ignition of combustible material in the environment surrounding the electrical connector assembly. Spark containment is an important safety feature of this invention and can be used on any electrical connector regardless of the temperature of, or location in, the wellhead.

Although O-ring seals have been shown in the figures other pliant seals can be used including cups seals. Although screw connections have been used other means of connecting the tubular assembly housing to the tubing hanger member, the housing to the crossover sealing adapter, and the locking member to the adapter can be used including flange pairs and other means. Also, if desired, other means of holding the lower electrical connector in the housing can be used if desired including a snap ring and groove combination. In such alternative embodiment, the supporting second section 45 of the lower electrical connector 25 would include a grove, the supporting second means 50 of the annular retainer member would be a snap ring.

While the preferred embodiments of the present invention have been described, it should be understood that various changes, adaptations and modifications may be made thereto without departing from the spirit of the invention and the scope of the appended claims. It should be understood, therefore, that the invention is not to be limited to minor details of the illustrated invention shown in preferred embodiment and the figures, and that variations in such minor details will be apparent to one skilled in the art.

Therefore it is to be understood that the present disclosure and embodiments of this invention described herein are for purposes of illustration and example and that modifications and improvements may be made thereto without departing from the spirit of the invention or from the scope of the claims. The claims, therefore, are to be accorded a range of equivalents commensurate in scope with the advances made over the art.

What is claimed is:

1. An elevated electrical connector assembly for use in a wellhead operating at an elevated temperature, the elevated electrical connector assembly comprising:

a removable tubular assembly housing;

a removable lower electrical connector;

a removable annular retainer member;

a removable crossover sealing adapter;

a removable upper electrical connector; and a removable annular locking member, wherein the tubular assembly housing includes a housing lower connecting end having threaded first means for attaching to a threaded coupling port in a first wellhead member of the wellhead, a pass-through part located near the housing lower connecting end and for traversing a bore in a second wellhead member of the wellhead, a housing upper connecting end having a coupling first part, and a housing passageway between the housing lower and upper connecting ends, wherein the lower electrical connector includes a lower cable-connecting end for electrical connection to an electrical cable, an upper end for electrical connection to the upper electrical connector, therebelow a cylindrical upper first section, and therebelow a supporting second section, wherein the annular retainer member includes supporting second means for supporting and maintaining the cylindrical upper first section of the lower electrical connector outside the tubular assembly housing a predetermined distance from the housing upper connecting end, wherein the crossover sealing adapter includes an adapter lower end, an adapter upper end, and an adapter passageway therebetween, coupling third means near the adapter lower end for connecting to the coupling first part of the tubular assembly housing, the adapter passageway having a bored first portion which is slidable over the cylindrical upper first section of the lower electrical connector, sealing fourth means for preventing leakage between the bored first portion and the cylindrical upper first section of the lower electrical connector, a bored second portion in the adapter passageway between the adapter upper end and the bored first portion, and a coupling third portion near the adapter upper end for coupling to the annular locking member, and wherein the upper electrical connector includes a lower end, an upper cable-connecting end for electrical connection to an electrical cable, a cylindrical lower sector which is slidable into the bored second portion of the crossover sealing adapter, and contact means for making electrical contact between the upper and lower electrical connectors, and wherein the annular locking member includes coupling fifth means for maintaining the lower end of the upper electrical connector in abutting relationship with the upper end of the lower electrical connector, the coupling fifth means also for coupling to the coupling third portion of the crossover sealing adapter, and wherein, when the elevated electrical connector assembly is installed in the wellhead, the tubular assembly housing has an effective length between its pass-through part and its housing upper connecting end for positioning the lower and upper electrical connectors a predetermined distance away from the wellhead that the elevated temperature of the wellhead will not cause damage to the lower and upper electrical connectors.

2. The elevated electrical connector assembly of claim 1, wherein the tubular assembly housing further includes displacement means for displacing the housing upper connecting end away from hot components connected to the wellhead.

3. The elevated electrical connector assembly of claim 2, wherein the displacement means includes a swivel joint in the tubular assembly housing.

4. The elevated electrical connector assembly of claim 1, wherein the coupling third portion of the crossover sealing adapter is a threaded coupling third portion, and wherein the coupling fifth means of the annular locking member is threaded coupling fifth means.

5. The elevated electrical connector assembly of claim 1, wherein the coupling third portion of the crossover sealing adapter is a threaded coupling third portion, and wherein the coupling fifth means of the annular locking member is threaded coupling fifth means, wherein the upper electrical connector further includes a counter-threaded sector located above the cylindrical lower sector, wherein the annular locking member further includes counter-threaded means for engaging the counter-threaded sector, the counter-threaded means being located above the threaded coupling fifth means, and wherein upon breaking electrical contact between the upper and lower electrical connectors spark produced is confined to within the crossover sealing adapter.

6. An elevated electrical connector assembly for confining spark and for use in a wellhead operating at an elevated temperature, the elevated electrical connector assembly comprising:

a removable tubular assembly housing which includes a housing lower connecting end having threaded first means for attaching to a threaded coupling port in a first wellhead member of the wellhead, a pass-through part located near the housing lower connecting end and for traversing a bore in a second wellhead member of the wellhead, a housing upper connecting end, and a housing passageway between the housing lower and upper connecting ends;

a removable lower electrical connector which includes a lower cable-connecting end for electrical connection to an electrical cable, and an upper end for making electrical contact;

retainer means for maintaining the lower electrical connector partly above the housing upper connecting end;

sealing means for preventing fluid flow from the housing upper connecting end;

a removable upper electrical connector which includes an upper cable-connecting end for electrical connection to an electrical cable, a lower end having contact means for making electrical contact with the lower electrical connector;

coupling-confinement means for coupling the lower end of the upper electrical connector in abutting relationship with the upper end of the lower electrical connector and for confining spark produced upon breaking electrical contact between the upper and lower electrical connectors to within the elevated electrical connector assembly, and wherein, when the elevated electrical connector assembly is installed in the wellhead, the tubular assembly housing has an effective length between its pass-through part and its housing upper connecting end for positioning the lower and upper electrical connectors a predetermined distance away from the wellhead that the elevated temperature of the wellhead will not cause damage to the lower and upper electrical connectors.

7. The elevated electrical connector assembly of claim 6, wherein the tubular assembly housing further includes displacement means for displacing the housing upper connecting end away from hot components connected to the wellhead.

8. The elevated electrical connector assembly of claim 7, wherein the displacement means is comprises a swivel joint in the tubular assembly housing.

9. The elevated electrical connector assembly of claim 6, wherein the coupling-confinement means comprises a right hand threaded coupling and a left hand threaded coupling both of which remain partly coupled upon breaking electrical contact thereby confining spark produced to within the elevated electrical connector assembly.

10. The elevated electrical connector assembly of claim 6, wherein the coupling-confinement means further includes a removable crossover sealing adapter having a threaded coupling portion, and an annular locking member having threaded coupling means for coupling to the threaded coupling portion of the crossover sealing adapter, wherein the upper electrical connector further includes a counter-threaded sector, and the annular locking member further includes counter-threaded means for coupling to the counter-threaded sector of the upper electrical connector, and wherein the counter-threaded sector of the upper electrical connector and the counter-threaded means of the annular locking member, and the threaded coupling portion of the crossover sealing adapter and the threaded coupling means of the annular locking member, remain at least partly threadedly engaged upon breaking electrical contact between the upper and lower electrical connectors thereby confining any spark produced to within the crossover sealing adapter.

11. The elevated electrical connector assembly of claim 10, wherein the threaded coupling means and the coupling counter-threaded means of the crossover sealing adapter are spaced apart.

12. The elevated electrical connector assembly of claim 1, wherein the pass-through part of the tubular assembly housing has means for preventing leakage between the pass-through part and the bored second wellhead member.

13. The elevated electrical connector assembly of claim 1, wherein the coupling first part of the tubular assembly housings an externally threaded section, and wherein the coupling third means of the crossover sealing adapter is an internally threaded section which screws onto the externally threaded section.

14. The elevated electrical connector assembly of claim 1, wherein the supporting second section of the lower electrical connector is an externally threaded supporting second section, and wherein the coupling second means of the annular retainer member is an internally threaded section which screws onto the externally threaded supporting second section thereby maintaining the first section of the lower electrical connector outside the tubular assembly housing the predetermined distance from the housing upper connecting end.

15. The elevated electrical connector assembly of claim 1, wherein the sealing fourth means of the crossover sealing adapter includes an inner circumferential recess in its bored first portion, and a pliable seal carried by the inner circumferential recess which abuts the cylindrical upper first section of the lower electrical connector.

16. The elevated electrical connector assembly of claim 1, wherein the lower electrical connector has an external shoulder between the cylindrical upper first section and the supporting second section, and wherein the annular retainer member has an internal shoulder which abuts the external shoulder.

17. The elevated electrical connector assembly of claim 1, wherein the housing upper connecting end of the tubular assembly housing has a flat surface, and the annular retainer member has a lower flat surface which abuts the flat surface.

18. The elevated electrical connector assembly of claim 1, wherein the annular retainer member has an upper external flat surface, and the crossover sealing adapter has an internal shoulder between its bored first portion and its coupling third means which abuts the upper external flat surface.

19. The elevated electrical connector assembly of claim 1, wherein the upper electrical connector has a lower external shoulder between the first sector and its upper cable-connecting end, and the crossover sealing adapter has a flat surface on its adapter upper end which abuts the lower external shoulder of the upper electrical connector.

20. The elevated electrical connector assembly of claim 1, wherein the upper electrical connector has an upper external shoulder between its first sector and its upper cable-connecting end, and wherein the annular locking member has an internal shoulder which abuts the upper external shoulder.

21. The elevated electrical connector assembly of claim 1, wherein the upper electrical connector has a pliable seal adjacent its cylindrical lower sector, and the pliable seal abuts the bored second portion of the crossover sealing adapter.

22. The elevated electrical connector assembly of claim 1, wherein the upper electrical connector includes an inner circumferential recess in its cylindrical lower sector, and a pliable seal carried by the inner circumferential recess which abuts the bored second portion of the crossover sealing adapter.

23. The elevated electrical connector assembly of claim 1, further comprising an annular member surrounding a portion of the pass-through part of the tubular assembly housing, fastener means for attaching the annular member to the second wellhead member, and a pliable seal sandwiched between the annular member, the second wellhead member, and the pass-through part of the tubular assembly housing for preventing leakage from the bore of the second wellhead member.

24. An elevated electrical connector assembly for confining spark and for use in a wellhead operating at an elevated temperature, the elevated electrical connector assembly comprising:

a removable tubular assembly housing;

a removable lower electrical connector;

a removable annular retainer member;

a removable crossover sealing adapter;

a removable upper electrical connector; and a removable annular locking member, wherein the tubular assembly housing includes a housing lower connecting end having threaded first means for attaching to a threaded coupling port in a first wellhead member of the wellhead, a pass-through part located near the housing lower connecting end and for traversing a bore in a second wellhead member of the wellhead, a housing upper connecting end having a coupling first part, and a housing passageway between the housing lower and upper connecting ends, wherein the lower electrical connector includes a lower cable-connecting end for electrical connection to an electrical cable, an upper end for electrical connection to the upper electrical connector, therebelow a cylindrical upper first section, and therebelow a supporting second section, wherein the annular retainer member includes supporting second means for supporting and maintaining the cylindrical upper first section of the lower electrical connector outside the tubular assembly housing a predetermined distance from the housing upper connecting end, wherein the crossover sealing adapter includes an adapter lower end, an adapter upper end, and an adapter passageway therebetween, coupling third means near the adapter lower end for connecting to the coupling first part of the tubular assembly housing, the adapter passageway having a bored first portion which is slidable over the cylindrical upper first section of the lower electrical connector, sealing fourth means for preventing leakage between the bored first portion and the cylindrical upper first section of the lower electrical connector, a bored second portion in the adapter passageway between the adapter upper end and the bored first portion, and a threaded coupling third portion near the adapter upper end for coupling to the annular locking member, and wherein the upper electrical connector includes a lower end, an upper cable-connecting end for electrical connection to an electrical cable, a cylindrical lower sector which is slidable into the bored second portion of the crossover sealing adapter, and contact means for making electrical contact between the upper and lower electrical connectors, and wherein the annular locking member includes threaded coupling fifth means for maintaining the lower end of the upper electrical connector in abutting relationship with the upper end of the lower electrical connector, the threaded coupling fifth means also for coupling to the threaded coupling third portion of the crossover sealing adapter, wherein, when the elevated electrical connector assembly is installed in the wellhead, the tubular assembly housing has an effective length between its pass-through part and its housing upper connecting end for positioning the lower and upper electrical connectors a predetermined distance away from the wellhead that the elevated temperature of the wellhead will not cause damage to the lower and upper electrical connectors, wherein the upper electrical connector further includes a counter-threaded sector, and the annular locking member further includes counter-threaded means for engaging the counter-threaded sector, and wherein the counter-threaded sector and the counter-threaded means remain partly threadedly engaged, and the threaded coupling third portion of the crossover sealing adapter and the threaded coupling fifth means of the annular locking member, remain partly threadedly engaged upon breaking electrical contact between the upper and lower electrical connector thereby confining any spark produced to within the crossover sealing adapter.

25. An elevated electrical connector assembly for use in a wellhead operating at an elevated temperature, the elevated electrical connector assembly comprising:

a removable tubular assembly housing;

a removable lower electrical connector;

a removable annular retainer member;

a removable crossover sealing adapter;

a removable upper electrical connector; and a removable annular locking member, wherein the tubular assembly housing includes a housing lower connecting end having threaded first means for attaching to a threaded coupling port in a wellhead member of the wellhead, a housing upper connecting end having a coupling first part, and a housing passageway between the housing lower and upper connecting ends, wherein the lower electrical connector includes a lower cable-connecting end for electrical connection to an electrical cable, an upper end for electrical connection to the upper electrical connector, therebelow a cylindrical upper first section, and therebelow a supporting second section, wherein the annular retainer member includes supporting second means for supporting and maintaining the cylindrical upper first section of the lower electrical connector outside the tubular assembly housing a predetermined distance from the housing upper connecting end, wherein the crossover sealing adapter includes an adapter lower end, an adapter upper end, and an adapter passageway therebetween, coupling third means near the adapter lower end for connecting to the coupling first part of the tubular assembly housing, the adapter passageway having a bored first portion which is slidable over the cylindrical upper first section of the lower electrical connector, sealing fourth means for preventing leakage between the bored first portion and the cylindrical upper first section of the lower electrical connector, a bored second portion in the adapter passageway between the adapter upper end and the bored first portion, and a coupling third portion near the adapter upper end for coupling to the annular locking member, and wherein the upper electrical connector includes a lower end, an upper cable-connecting end for electrical connection to an electrical cable, a cylindrical lower sector which is slidable into the bored second portion of the crossover sealing adapter, and contact means for making electrical contact between the upper and lower electrical connectors, and wherein the annular locking member includes coupling fifth means for maintaining the lower end of the upper electrical connector in abutting relationship with the upper end of the lower electrical connector, the coupling fifth means also for coupling to the coupling third portion of the crossover sealing adapter, and wherein, when the elevated electrical connector assembly is installed in the wellhead, the tubular assembly housing has an effective length between the wellhead and the housing upper connecting end for positioning the lower and upper electrical connectors a predetermined distance away from the wellhead that the elevated temperature of the wellhead will not cause damage to the lower and upper electrical connectors.

26. An elevated electrical connector assembly for confining spark and for use in a wellhead operating at an elevated temperature, the elevated electrical connector assembly comprising:

a removable tubular assembly housing which includes a housing lower connecting end having threaded first means for attaching to a threaded coupling port in a wellhead member of the wellhead, a housing upper connecting end, and a housing passageway between the housing lower and upper connecting ends;

a removable lower electrical connector which includes a lower cable-connecting end for electrical connection to an electrical cable, and an upper end for making electrical contact;

retainer means for maintaining the lower electrical connector partly above the housing upper connecting end;

sealing means for preventing fluid flow from the housing upper connecting end;

a removable upper electrical connector which includes an upper cable-connecting end for electrical connection to an electrical cable, a lower end having contact means for making electrical contact with the lower electrical connector;

coupling-confinement means for coupling the lower end of the upper electrical connector in abutting relationship with the upper end of the lower electrical connector and for confining spark produced upon breaking electrical contact between the upper and lower electrical connectors to within the elevated electrical connector assembly, and wherein, when the elevated electrical connector assembly is installed in the wellhead, the tubular assembly housing has an effective length between the wellhead member and the housing upper connecting end for positioning the lower and upper electrical connectors a predetermined distance away from the wellhead that the elevated temperature of the wellhead will not cause damage to the lower and upper electrical connectors.

27. An elevated electrical connector assembly for confining spark and for use in a wellhead operating at an elevated temperature, the elevated electrical connector assembly comprising:

a removable tubular assembly housing;

a removable lower electrical connector;

a removable annular retainer member;

a removable crossover sealing adapter;

a removable upper electrical connector; and a removable annular locking member, wherein the tubular assembly housing includes a housing lower connecting end having threaded first means for attaching to a threaded coupling port in a wellhead member of the wellhead, a housing upper connecting end having a coupling first part, and a housing passageway between the housing lower and upper connecting ends, wherein the lower electrical connector includes a lower cable-connecting end for electrical connection to an electrical cable, an upper end for electrical connection to the upper electrical connector, therebelow a cylindrical upper first section, and therebelow a supporting second section, wherein the annular retainer member includes supporting second means for supporting and maintaining the cylindrical upper first section of the lower electrical connector outside the tubular assembly housing a predetermined distance from the housing upper connecting end, wherein the crossover sealing adapter includes an adapter lower end, an adapter upper end, and an adapter passageway therebetween, coupling third means near the adapter lower end for connecting to the coupling first part of the tubular assembly housing, the adapter passageway having a bored first portion which is slidable over the cylindrical upper first section of the lower electrical connector, sealing fourth means for preventing leakage between the bored first portion and the cylindrical upper first section of the lower electrical connector, a bored second portion in the adapter passageway between the adapter upper end and the bored first portion, and a threaded coupling third portion near the adapter upper end for coupling to the annular locking member, and wherein the upper electrical connector includes a lower end, an upper cable-connecting end for electrical connection to an electrical cable, a cylindrical lower sector which is slidable into the bored second portion of the crossover sealing adapter, and contact means for making electrical contact between the upper and lower electrical connectors, and wherein the annular locking member includes threaded coupling fifth means for maintaining the lower end of the upper electrical connector in abutting relationship with the upper end of the lower electrical connector, the threaded coupling fifth means also for coupling to the threaded coupling third portion of the crossover sealing adapter, wherein, when the elevated electrical connector assembly is installed in the wellhead, the tubular assembly housing has an effective length between the wellhead member and the housing upper connecting end for positioning the lower and upper electrical connectors a predetermined distance away from the wellhead that the elevated temperature of the wellhead will not cause damage to the lower and upper electrical connectors, wherein the upper electrical connector further includes a counter-threaded sector, and the annular locking member further includes counter-threaded means for engaging the counter-threaded sector, and wherein the counter-threaded sector and the counter-threaded means remain partly threadedly engaged, and the threaded coupling third portion of the crossover sealing adapter and the threaded coupling fifth means of the annular locking member, remain partly threadedly engaged upon breaking electrical contact between the upper and lower electrical connector thereby confining any spark produced to within the crossover sealing adapter.

* * * * *

UNITED STATES PATENT AND TRADEMARK OFFICE

CERTIFICATE OF CORRECTION

PATENT NO. : 5,795,169

DATED : Aug. 18, 1998

INVENTOR(S) : Lehman Thoren Reed

It is certified that error appears in the above-indentified patent and that said Letters Patent is hereby corrected as shown below:

Title page, after the left hand column:

[22] Filed: Dec. 3, 1996 insert:

--[62] Related U.S. Application Date
Continuation-in-Part of Ser. No. 08/528,771, Sept. 15, 1995, abandoned.--

Signed and Sealed this

Sixteenth Day of March, 1999

*Attest:*

Q. TODD DICKINSON

*Attesting Officer*

*Acting Commissioner of Patents and Trademarks*